US009703223B2

(12) United States Patent
Okubo et al.

(10) Patent No.: US 9,703,223 B2
(45) Date of Patent: Jul. 11, 2017

(54) TONER, DEVELOPER, AND TONER CARTRIDGE

(71) Applicant: HODOGAYA CHEMICAL CO., LTD, Tokyo (JP)

(72) Inventors: Masaki Okubo, Tokyo (JP); Motonori Tsuji, Tokyo (JP); Masami Ito, Inagi (JP); Masaya Tojo, Tsukuba (JP); Masafumi Asakai, Tokyo (JP); Tetsuya Yoshida, Tokyo (JP)

(73) Assignee: HODOGAYA CHEMICAL CO., LTD., Tokyo (JP)

( * ) Notice: Subject to any disclaimer, the term of this patent is extended or adjusted under 35 U.S.C. 154(b) by 0 days.

(21) Appl. No.: 14/914,710

(22) PCT Filed: Sep. 24, 2014

(86) PCT No.: PCT/JP2014/075300
§ 371 (c)(1),
(2) Date: Feb. 26, 2016

(87) PCT Pub. No.: WO2015/046255
PCT Pub. Date: Apr. 2, 2015

(65) Prior Publication Data

US 2016/0209769 A1 Jul. 21, 2016

(30) Foreign Application Priority Data

Sep. 25, 2013 (JP) ..... 2013-197675

(51) Int. Cl.
*G03G 9/097* (2006.01)
*G03G 9/08* (2006.01)
*G03G 9/107* (2006.01)
*G03G 9/113* (2006.01)

(52) U.S. Cl.
CPC ..... *G03G 9/09758* (2013.01); *G03G 9/0804* (2013.01); *G03G 9/0819* (2013.01); *G03G 9/09733* (2013.01); *G03G 9/107* (2013.01); *G03G 9/1132* (2013.01)

(58) Field of Classification Search
CPC ..... G03G 9/09758; G03G 9/09733
USPC ..... 430/108.1
See application file for complete search history.

(56) References Cited

U.S. PATENT DOCUMENTS 5,679,489 A * 10/1997 Mukudai ..... G03G 9/09733 430/108.1
5,935,752 A 8/1999 Ueda et al.
6,080,519 A * 6/2000 Ishiyama ..... G03G 9/0821 430/110.3
6,534,231 B1 3/2003 Yamanaka et al.
2003/0068496 A1 4/2003 Wei et al.
2006/0045571 A1* 3/2006 Matsuura ..... G03G 21/0064 399/149

FOREIGN PATENT DOCUMENTS

| | | | |
|---|---|---|---|
| JP | 7-175269 | A | 7/1995 |
| JP | 8-166691 | A | 6/1996 |
| JP | 2568675 | B2 | 1/1997 |
| JP | 10-161348 | A | 6/1998 |
| JP | 10-161349 | A | 6/1998 |
| JP | 10-298160 | A | 11/1998 |
| JP | 2899038 | B2 | 6/1999 |
| JP | 2000-147838 | A | 5/2000 |
| JP | 2000-162825 | A | 6/2000 |
| JP | 2001-265064 | A | 9/2001 |
| JP | 3313871 | B2 | 8/2002 |
| JP | 3325730 | B2 | 9/2002 |
| JP | 3359657 | B2 | 12/2002 |
| JP | 2003-162100 | A | 6/2003 |
| JP | 2003-295522 | A | 10/2003 |
| WO | 2007/111346 | A1 | 10/2007 |

OTHER PUBLICATIONS

International Search Report for PCT/JP2014/075300 dated Nov. 25, 2014.
International Preliminary Report on Patentability dated Apr. 7, 2016, issued by the International Bureau in application No. PCT/JP2014/075300.

* cited by examiner

*Primary Examiner* — Janis L Dote
(74) *Attorney, Agent, or Firm* — Sughrue Mion, PLLC

(57) ABSTRACT

The present invention provides a toner that includes a charge control agent containing one or two or more resorcin derivatives represented by the following formula (1), a colorant, and a binder resin.

(1)

9 Claims, No Drawings

TONER, DEVELOPER, AND TONER CARTRIDGE

CROSS REFERENCE TO RELATED APPLICATIONS

This application is a National Stage of International Application No. PCT/JP2014/075300 filed Sep. 24, 2014, claiming priority based on Japanese Patent Application No. 2013-197675 filed Sep. 25, 2013.

TECHNICAL FIELD

The present invention relates to a toner, a developer and a toner cartridge. The present invention further relates to a charge control agent used in an image-forming apparatus for developing an electrostatic latent image in the field of electrophotography, electrostatic recording or the like, and a negatively charged toner containing the charge control agent.

BACKGROUND ART

In an image-forming process of an electrophotographic system, an electrostatic latent image is formed on an inorganic photoreceptor formed of selenium, a selenium alloy, cadmium sulfate, amorphous silicon, etc. or an organic photoreceptor using a charge generation materials and a charge transport materials, developed with a toner, and transferred and fixed to a paper sheet or a plastic film to obtain a visible image.

Photoreceptors are classified into positively charged ones and negatively charged ones depending upon their structures. In the case where a printed portion is allowed to remain as an electrostatic latent image by light exposure, the latent image is developed with a toner charged with reverse polarity. In contrast, in the case where a printed portion is electrically discharged and subjected to reversal development, the printed portion is developed with a toner charged with the same polarity.

A toner contains a binder resin, a colorant and other additives. To impart desirable charging characteristics (charge rate, charge level, charge stability, etc.), temporal stability, environmental stability and the like, a charge control agent is generally added. Owing to the addition of the charge control agent, the characteristics of a toner are greatly improved.

Examples of a positive triboelectric charge control agent presently known in the art include a nigrosine dye, an azine dye, a copper phthalocyanine pigment, a quaternary ammonium salt and a polymer having a quaternary ammonium salt at a side chain. Examples of a negative triboelectric charge control agent presently known in the art include metal complexes of a monoazo dye, metal complexes of salicylic acid, naphthoic acid or dicarboxylic acid, a copper phthalocyanine pigment and a resin containing an acid component.

Furthermore, in the case of a color toner, market expansion of which is expected in the future, a pale-colored charge control agent having little effect on hue, desirably a colorless charge control agent, is indispensable. Examples of such a pale-colored or colorless charge control agent for use in a negatively charged toner include metal complex compounds of hydroxy benzoate derivatives (see, for example, Patent Literatures 1 to 3), metal salt compounds of aromatic dicarboxylic acids (see, for example, Patent Literature 4), metal complex compounds of anthranilic acid derivatives (see, for example, Patent Literatures 5 and 6), organic boron compounds (see, for example, Patent Literatures 7 and 8), biphenol compounds (see, for example, Patent Literature 9), calix[n]arene compounds (see, for example, Patent Literatures 10 to 15) and cyclic phenol sulfates (see, for example, Patent Literatures 16 to 18). Furthermore, examples thereof for use in a positively charged toner include quaternary ammonium salt compounds (see, for example, Patent Literatures 19 to 21).

CITATION LIST

Patent Literature

Patent Literature 1: Japanese Examined Patent Publication No. S55-042752

Patent Literature 2: Japanese Unexamined Patent Publication No. S61-069073

Patent Literature 3: Japanese Unexamined Patent Publication No, S61-221756

Patent Literature 4: Japanese Unexamined Patent Publication No. S57-111541

Patent Literature 5: Japanese Unexamined Patent Publication No. S61-141453

Patent Literature 6: Japanese Unexamined Patent Publication No. S62-094856

Patent Literature 7: U.S. Pat. No. 4,767,688

Patent Literature 8: Japanese Unexamined Patent Publication No. H1-306861

Patent Literature 9: Japanese Unexamined Patent Publication No. S61-003149

Patent Literature 10: Japanese Patent No. 2568675

Patent Literature 11: Japanese Patent No. 2899038

Patent Literature 12: Japanese Patent No. 3359657

Patent Literature 13: Japanese Patent No. 3313871

Patent Literature 14: Japanese Patent No. 3325730

Patent Literature 15: Japanese Unexamined Patent Publication No. 2003-162100

Patent Literature 16: Japanese Unexamined Patent Publication No. H7-175269

Patent Literature 17: Japanese Unexamined Patent Publication No. 2003-295522

Patent Literature 18: WO 2007-111346 A

Patent Literature 19: WO 2007-119797

Patent Literature 20: Japanese Unexamined Patent Publication No. S57-119364

Patent Literature 21: Japanese Unexamined Patent Publication No. S58-009154

Patent Literature 22: Japanese Unexamined Patent Publication No. S58-098742

SUMMARY OF INVENTION

Problems to be Solved by the Invention

However, most of these charge control agents are complexes formed of heavy metals such as chromium or salts thereof. They have problems regarding waste regulation and are not necessarily safe. Further, they do not have sufficient charging characteristics such as a charge imparting effect and environmental stability. They also have a defect in that they cannot be applied to a polymerization toner. Therefore, it has been desired to develop a charge control agent that has excellent charging characteristics and that can be applied to a polymerization toner.

The present invention was made to solve the above-described problems and intends to provide a safe, negatively charged charge control agent that has excellent charging characteristics such as the charge-imparting effect and environmental stability, that is suitable for application to a polymerization toner, and that is also free from the problem of waste regulation. Further, the invention intends to provide a negatively charged toner that uses the charge control agent and has high charging characteristics, in particular, a negatively charged polymerization toner.

Means for Solving the Problems

The present invention was obtained by intensively studying to achieve the object described above and has the following gist.

[1] A toner including a charge control agent containing one or more resorcin derivatives represented by the following formula (1) as an active substance(s), a colorant, and a binder resin.

[Chemical Formula 1]

(1)

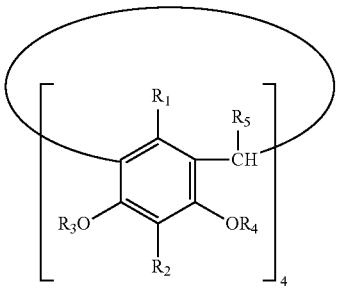

In formula (1), $R_1$ and $R_2$, which may be identical to or different from each other, represent a hydrogen atom, a deuterium atom, a halogen atom, as hydroxyl group, a nitro group, a carboxyl group, an ester group, a linear or branched alkyl group having 1 to 20 carbon atoms which may have a substituent, a cycloalkyl group having 5 to 10 carbon atoms which may have a substituent, a linear or branched alkyloxy group having 1 to 20 carbon atoms which may have a substituent, a cycloalkyloxy group having 5 to 10 carbon atoms which may have a substituent, an acyl group having 2 to 6 carbon atoms which may have a substituent, a substituted or unsubstituted aromatic hydrocarbon group, a substituted or unsubstituted heterocyclic group, or a substituted or unsubstituted condensed polycyclic aromatic group. $R_3$ and $R_4$, which may be identical to or different from each other, represent a hydrogen atom, a deuterium atom, a linear or branched alkyl group having 1 to 20 carbon atoms which may have a substituent, a cycloalkyl group having 5 to 10 carbon atoms which may have a substituent, a substituted or unsubstituted aromatic hydrocarbon group, a substituted or unsubstituted heterocyclic group, or a substituted or unsubstituted condensed polycyclic aromatic group. $R_5$s, which may be identical to or different from each other, represent a hydrogen atom, a deuterium atom, a linear or branched alkyl group having 1 to 20 carbon atoms which may have a substituent, a cycloalkyl group having 5 to 10 carbon atoms which may have a substituent, a substituted or unsubstituted aromatic hydrocarbon group, a substituted or unsubstituted heterocyclic group, or a substituted or unsubstituted condensed polycyclic aromatic group. $R_3$ and $R_4$ may be joined to each other via a single bond to form a ring.

[2] The toner according to [1], wherein a volume average particle size is from 2 μm to 9.5 μm.

[3] A polymerization toner including a charge control agent containing one or more resorcin derivatives represented by the formula (1) described above as an active substance(s), a colorant, and a binder resin.

[4] An emulsion aggregation toner including a charge control agent containing one or more resorcin derivatives represented by the formula (1) described above as an active substance(s), a colorant, and a binder resin.

[5] A suspension polymerization toner including a charge control agent containing one or more resorcin derivatives represented by the formula (1) described above as an active substance(s), a colorant, and a binder resin.

[6] A developer including any one of the toners described above and a carrier.

[7] A developer including the emulsion aggregation toner described above and a resin-coated carrier.

[8] A developer including the suspension polymerization toner described above and a non-coated carrier.

[9] A toner cartridge including any one of the developers described above.

Effects of the Invention

A charge control agent according to the present invention has a sharp rising rate of charging, a high charge amount and having charging characteristics particularly excellent in environmental stability, compared with a conventional charge control agent. Further, it does not contain heavy metals such as chromium that may cause a problem from an environmental point of view and is also excellent in dispersibility and stability of a compound. The charge control agent according to the present invention is particularly useful for use in a color toner, further for use in a polymerization toner.

The toner of the invention includes the charge control agent of the invention and therefore has excellent sharpness of initial copied images and can suppress the quality of a copied image from varying during continual copying. The toner of the invention is free from fog and can therefore obtain an image having excellent image density, dot reproducibility, and thin-line reproducibility. The toner of the invention is preferred for use in the development of electrostatic charge images and for use in electronic photography.

EMBODIMENTS FOR CARRYING OUT THE INVENTION

Hereinafter, embodiments for carrying out the present invention will be described in detail. It should be noted that the present invention is not limited to the following embodiments and can be carried out by variously modifying within the scope of its gist.

[Toner]

The toner of the invention includes a charge control agent (hereinafter, also referred to as "charge control agent of the invention") containing one or two or more kinds of resorcin derivatives represented by formula (1) described above as an active substance(s), a colorant, and a binder resin.

[Charge Control Agent]

Firstly, the resorcin derivatives represented by formula (1) described above will be described.

In formula (1), specific examples of a "halogen atom" represented by $R_1$ and $R_2$ include a fluorine atom, a chlorine atom, a bromine atom, an iodine atom or the like.

In formula (1), an "ester group" represented by $R_1$ and $R_2$ means an "alkyloxycarbonyl group" or an "aryloxycarbonyl group". Specific examples of the "alkyloxy group" in the "alkyloxycarbonyl group" include linear or branched alkyloxy groups having 1 to 20 carbon atoms such as a methyloxy group, an ethyloxy group, an n-propyloxy group, a 2-propyloxy group, an n-butyloxy group, a sec-butyloxy group, a 2-methylpropyloxy group, a tert-butyloxy group, an n-pentyloxy group, a 1-methylbuthyloxy group, a 1-ethylpropyloxy group, a 1,1-dimethylpropyloxy group, a 1,2-dimethylpropyloxy group, an n-hexyloxy group, a 1-methylpentyloxy group, a 2-methylpentyloxy group, a 3-methylpentyloxy group, a 4-methylpentyloxy group, a 1-ethylbutyloxy group, a 2-ethylbutyloxy group, a 1,1-dimethylbutyloxy group, a 1,2-dimethylbutyloxy group, a 1,3-dimethylbutyloxy group, a 1,4-dimethylbutyloxy group, a 2,2-dimethylbutyloxy group, a 2,3-dimethylbutyloxy group, a 3,3-dimethylbutyloxy group, a 1-ethyl-2-methylpropyloxy group, a 1,1,2-trimethylpropyloxy group, an n-heptyloxy group, a 2-methylhexyloxy group, an n-octyloxy group, an isooctyloxy group, a tert-octyloxy group, a 2-ethylhexyloxy group, a 3-methylheptyloxy group, an n-nonyloxy group, an isononyloxy group, a 1-methyloctyloxy group, a 2-ethylheptyloxy group, an n-decyloxy group, a 1-methylnonyloxy group, an n-undecyloxy group, a 1,1-dimethylnonyloxy group, an n-dodecyloxy group, an n-tetradecyloxy group, an n-heptadecyloxy group, an n-octadecyloxy group and the like. Specific examples of the "aryloxy group" in the "aryloxycarbonyl group" include a phenyloxy group, a biphenylyloxy group, a naphtyloxy group, an anthryloxy group, a phenanthryloxy group, a pyrizyloxy group, a furiloxy group, a pyrolyloxy group, a thienyloxy group, a quinolyloxy group, an isoquinolyloxy group, a pyrazolyloxy group and the like.

In formula (1), specific examples of "the linear or branched alkyl group having 1 to 20 carbon atoms" or "the cycloalkyl group having 5 to 10 carbon atoms" in the "linear or branched alkyl group having 1 to 20 carbon atoms which may have a substituent" or the "cycloalkyl group having 5 to 10 carbon atoms which may have a substituent" represented by $R_1$ and $R_2$ include a methyl group, an ethyl group, an n-propyl group, a 2-propyl group, an n-butyl group, a sec-butyl group, a 2-methylpropyl group, a tert-butyl group, an n-pentyl group, a 1-methylbutyl group, a 1-ethylpropyl group, a 1,1-dimethylpropyl group, a 1,2-dimethylpropyl group, an n-hexyl group, a 1-methylpentyl group, a 2-methylpentyl group, a 3-methylpentyl group, a 4-methylpentyl group, a 1-ethylbutyl group, a 2-ethylbutyl group, a 1,1-dimethylbutyl group, a 1,2-dimethylbutyl group, a 1,3-dimethylbutyl group, a 1,4-dimethylbutyl group, a 2,2-dimethylbutyl group, a 2,3-dimethylbutyl group, a 3,3-dimethylbutyl group, a 1-ethyl-2-methyl-propyl group, a 1,1,2-trimethylpropyl group, an n-heptyl group, a 2-methylhexyl group, an n-octyl group, an isooctyl group, a tert-octyl group, a 2-ethylhexyl group, a 3-methylheptyl group, an n-nonyl group, an isononyl group, a 1-methyloctyl group, a 2-ethylheptyl group, an n-decyl group, a 1-methylnonyl group, an n-undecyl group, a 1,1-dimethylnonyl group, an n-dodecyl group, an n-tetradecyl group, an n-heptadecyl group, an n-octadecyl group, a cyclopentyl group, a cyclohexyl group, a 1-adamantyl group, a 2-adamantyl group and the like.

In formula (1), specific examples of the "linear or branched alkyloxy group having 1 to 20 carbon atoms" or the "cycloalkyloxy group having 5 to 10 carbon atoms" in the "linear or branched alkyloxy group having 1 to 20 carbon atoms which may have a substituent" or the "cycloalkyloxy group having 5 to 10 carbon atoms which may have a substituent" represented by $R_1$ and $R_2$ include a methyloxy group, an ethyloxy group, an n-propyloxy group, a 2-propyloxy group, an n-butyloxy group, a sec-butyloxy group, a 2-methylpropyloxy group, a tert-butyloxy group, an n-pentyloxy group, a 1-methylbuthyloxy group, a 1-ethylpropyloxy group, a 1,1-dimethylpropyloxy group, a 1,2-dimethylpropyloxy group, an n-hexyloxy group, 1-methylpentyloxy group, a 2-methylpentyloxy group, a 3-methylpentyloxy group, a 4-methylpentyloxy group, a 1-ethylbutyloxy group, a 2-ethylbutyloxy group, a 1,1-dimethylbutyloxy group, a 1,2-dimethylbutyloxy group, a 1,3-dimethylbutyloxy group, a 1,4-dimethylbutyloxy group, a 2,2-dimethylbutyloxy group, a 2,3-dimethylbutyloxy group, a 3,3-dimethylbutyloxy group, a 1-ethyl-2-methylpropyloxy group, a 1,1,2-trimethylpropyloxy group, an n-heptyloxy group, a 2-methylhexyloxy group, an n-octyloxy group, an isooctyloxy group, a tert-octyloxy group, a 2-ethylhexyloxy group, a 3-methylheptyloxy group, an n-nonyloxy group, an isononyloxy group, a 1-methyloctyloxy group, a 2-ethylheptyloxy group, an n-decyloxy group, a 1-methylnonyloxy group, an n-undecyloxy group, a 1,1-dimethylnonyloxy group, an n-dodecyloxy group, an n-tetradecyloxy group, an n-heptadecyloxy group, an n-octadecyloxy group, a cyclopentyloxy group, a cyclohexyloxy group, a cycloheptyloxy group, a cyclooctyloxy group, a 1-adamantyloxy group, a 2-adamantyloxy group and the like.

In formula (1), specific examples of the "acyl group having 2 to 6 carbon atoms" in the "acyl group having 2 to 6 carbon atoms which may have a substituent" represented by $R_1$ and $R_2$ include an acetyl group, a propionyl group, a butanoyl group, a 2-methylpropionyl group, a pentanoyl group, a 1-methylbutanoyl group, a 1-ethylpropionyl group, a 1,1-dimethylpropionyl group, a 1,2-dimethylpropionyl group, a hexanoyl group, a 1-methylpentanoyl group, a 2-methylpentanoyl group, a 3-methylpentanoyl group, a 4-methylpentanoyl group, a 1-ethylbutanoyl group, a 2-ethylbutanoyl group, a 1,1-dimethylbutanoyl group, a 1,2-dimethylbutanoyl group, a 1,3-dimethylbutanoyl group, a 1,4-dimethylbutanoyl group, a 2,2-dimethylbutanoyl group, a 2,3-dimethylbutanoyl group, a 3,3-dimethylbutanoyl group, a 1-ethyl-2-methyl-propionyl group, a 1,1,2-trimethylpropionyl group and the like.

Specific examples of the "substituent" in the "linear or branched alkyl groups having 1 to 20 carbon atoms which have a substituent", the "cycloalkyl groups having 5 to 10 carbon atoms which have a substituent", the "linear or branched alkyloxy groups having 1 to 20 carbon atoms which have a substituent", the "cycloalkyloxy groups having 5 to 10 carbon atoms which have a substituent" or the "acyl groups having 2 to 6 carbon atoms which have a substituent" (hereinafter, also collectively referred to as "alkyl groups and the like having a substituent") represented by $R_1$ and $R_2$ include a deuterium atom, a trifluoromethyl group, a cyano group, a nitro group, a hydroxyl group; halogen atoms such as a fluorine atom, a chlorine atom, a bromine atom, and an iodine atom; linear or branched alkyl groups having 1 to 8 carbon atoms such as a methyl group, an ethyl group, an n-propyl group, an isopropyl group, an n-butyl group, an isobutyl group, a tert-butyl group, an n-pentyl group, an isopentyl group, a neopentyl group, an n-hexyl group, an n-heptyl group, an isoheptyl group, an n-octyl group, and an isooctyl group; $C_1$ to $C_8$ linear or branched alkyloxy groups such as a methyloxy group, an ethyloxy group, and propyloxy group; alkenyl groups such as an aryl group; aralkyl groups such as a benzyl group, a naphtylmethyl group, and a phenethyl group; aryloxy groups such as a phenyloxy group and a tolyloxy group; arylalkyloxy groups such as a benzyloxy group and a phenethyloxy group; aromatic hydrocarbon groups or condensed polycyclic aromatic groups such as a phenyl group, a biphenylyl group, a terphenylyl group, a naphthyl group, an anthracenyl group, a phenanthryl group, a fluorenyl group, an indenyl group, a pyrenyl group, a perylenyl group, a fluoranthenyl group, and a triphenylenyl group; heterocyclic groups such as a pyridyl group, a pyranyl group, a thienyl group, a furyl group, a pyrrolyl group, a pyrrolidinyl group, an imidazolyl group, an imidazolidinyl group, a pyrazolyl group, a pyrazolidinyl group, a pyridazinyl group, a pyradinyl group, a piperidinyl group, a piperadinyl group, a thioranyl group, a thianyl group, a quinolyl group, an isoquinolyl group, a benzofuranyl group, a benzothienyl group, an indolyl group, a carbazolyl group, a benzoxazolyl group, a benzothiazolyl group, a quinoxalyl group, a benzoimidazolyl group, a dibenzoffiranyl group, a dibenzothienyl group and a carbolinyl group; arylvinyl groups such as a styryl group and a naphthylvinyl group; acyl groups such as an acetyl group and a benzoyl group; dialkylamino groups such as a dimethylamino group and a diethylamine group; disubstituted amino groups substituted with an aromatic hydrocarbon group or a condensed polycyclic aromatic group, such as a diphenylamino group and a dinaphthylamino group; diaralkylamino groups such as a dibenzylamino group and a diphenetylamino group; disubstituted amino groups substituted with a heterocyclic group such as a dipyridylamino group, a dithienylamino group or a dipiperidinylamino group; dialkenyl amino groups such as a diallylamino group and the like; and a disubstituted amino group substituted with a substituent selected from an alkyl group, an aromatic hydrocarbon group, a condensed polycyclic aromatic group, an aralkyl group, a heterocyclic group and an alkenyl group. These substituents may further have another substituent illustrated above or may be mutually bonded via a single bond, an oxygen atom, or a sulfur atom to form a ring.

In formula (1), specific examples of the "aromatic hydrocarbon group", the "heterocyclic group" or the "condensed polycyclic aromatic group" in the "substituted or unsubstituted aromatic hydrocarbon groups", the "substituted or unsubstituted heterocyclic groups" or the "substituted or unsubstituted condensed polycyclic aromatic groups" represented by $R_1$ and $R_2$ include a phenyl group, a biphenylyl group, a terphenylyl group, a naphthyl group, an anthryl group, a phenanthryl group, a fluorenyl group, an indenyl group, a pyrenyl group, a perylenyl group, a fluorantenyl group, a triphenylenyl group, a pyridyl group, a furanyl group, a pyranyl group, a thienyl group, a pyrrolidinyl group, an imidazolyl group, an imidazolydinyl group, a pyrazolyl group, a pyrazolidinyl group, a pyridadinyl group, a pyradinyl group, a piperidinyl group, a piperadinyl group, a thioranyl group, a thianyl group, a quinolyl group, an isoquinolyl group, a benzofuranyl group, a benzothienyl group, an indolyl group, a carbazolyl group, a benzoxazolyl group, a benzothiazolyl group, a quinoxalyl group, a benzoimidazolyl group, a dibenzofuranyl group, a dibenzothienyl group, a carbolynyl group and the like.

In formula (1), as the "substituent" in the "substituted aromatic hydrocarbon group", the "substituted heterocyclic group" or the "substituted condensed polycyclic aromatic group" represented by $R_1$ and $R_2$, the same as those illustrated as the "substituent" in the "alkyl groups and the like having a substituent" represented by $R_1$ and $R_2$ can be used. Aspects that can be taken may also be the same as the above.

In formula (1), as the "linear or branched alkyl group having 1 to 20 carbon atoms" or the "cycloalkyl group having 5 to 10 carbon atoms" in the "linear or branched alkyl group having 1 to 20 carbon atoms which may have a substituent" or the "cycloalkyl group having 5 to 10 carbon atoms which may have a substituent" represented by $R_3$ and $R_4$, the same as those illustrated as the "linear or branched alkyl group having 1 to 20 carbon atoms" or the "cycloalkyl group having 5 to 10 carbon atoms" in the "linear or branched alkyl group having 1 to 20 carbon atoms which may have a substituent" or the "cycloalkyl group having 5 to 10 carbon atoms which may have a substituent" represented by $R_1$ and $R_2$ in the above formula (1) can be used.

In formula (1), as the "substituent" in the "linear or branched alkyl group having 1 to 20 carbon atoms which has a substituent" or the "cycloalkyl group having 5 to 10 carbon atoms which has a substituent" represented by $R_3$ and $R_4$, the same as those illustrated as the "substituent" in the "alkyl groups and the like having a substituent" represented by $R_1$ and $R_2$ in the above formula (1) can be used. Aspects that can be taken may also be the same as the above.

In formula (1), as the "aromatic hydrocarbon group", the "heterocyclic group" or the "condensed polycyclic aromatic group" in the "substituted or unsubstituted aromatic hydrocarbon group", the "substituted or unsubstituted heterocyclic group" or the "substituted or unsubstituted condensed polycyclic aromatic group" represented by $R_3$ and $R_4$, the same as those illustrated as the "aromatic hydrocarbon group", the "heterocyclic group" or the "condensed polycyclic aromatic group" in the "substituted or unsubstituted aromatic hydrocarbon group", the "substituted or unsubstituted heterocyclic group" or the "substituted or unsubstituted condensed polycyclic aromatic group" represented by $R_1$ and $R_2$ in the above formula (1) can be used.

In formula (1), as the "substituent" in the "substituted aromatic hydrocarbon group", the "substituted heterocyclic group" or the "substituted condensed polycyclic aromatic group" represented by $R_3$ and $R_4$, the same as those illustrated as the "substituent" in the "alkyl groups and the like having a substituent" represented by $R_1$ and $R_2$ in the above formula (1) can be used. Aspects that can be taken may also be the same as the above.

In formula (1), $R_3$ and $R_4$ may be mutually bonded via a single bond to form a ring. $R_3$ and $R_4$ that form the relevant ring may be present on the same resorcin ring or may be present on adjacent resorcin rings as shown in the following formula (2).

[Chemical Formula 2]

(2)

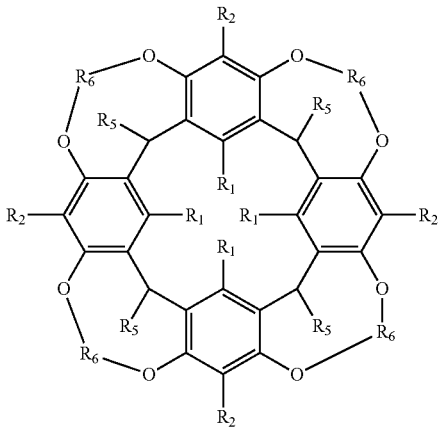

In formula (2), $R_6$s may be identical to or different from each other and represent a divalent group which is formed by mutual binding of $R_3$ and $R_4$ via a single bond. $R_1$, $R_2$, $R_3$, $R_4$ and $R_5$ have the same meaning as those in formula (1).

In formula (1), as the "linear or branched alkyl group having 1 to 20 carbon atoms" or the "cycloalkyl group having 5 to 10 carbon atoms" in the "linear or branched alkyl group having 1 to 20 carbon atoms which may have a substituent" or the "cycloalkyl group having 5 to 10 carbon atoms which may have a substituent" represented by $R_5$, the same as those illustrated as the "linear or branched alkyl group having 1 to 20 carbon atoms" or the "cycloalkyl group having 5 to 10 carbon atoms" in the "linear or branched alkyl group having 1 to 20 carbon atoms which may have a substituent" or the "cycloalkyl group having 5 to 10 carbon atoms which may have a substituent" represented by $R_1$ and $R_2$ in formula (1) can be used.

As the "substituents" in the "linear or branched alkyl groups having 1 to 20 carbon atoms which have a substituent" or "the cycloalkyl groups having 5 to 10 carbon atoms which have a substituent" represented by $R_5$ in formula (1), the same as those illustrated as the "substituent" in the "alkyl groups and the like having a substituent" represented by $R_1$ and $R_2$ the above formula (1) can be used. Aspects that can be taken may also be the same as the above.

As the "aromatic hydrocarbon groups", the "heterocyclic groups" or the "condensed polycyclic aromatic groups" in the "substituted or unsubstituted aromatic hydrocarbon groups", the "substituted or unsubstituted heterocyclic groups" or the "substituted or unsubstituted condensed polycyclic aromatic groups" represented by $R_5$ in formula (1), the same as those illustrated as the "aromatic hydrocarbon groups", the "heterocyclic groups" or the "condensed polycyclic aromatic groups" in the "substituted or unsubstituted aromatic hydrocarbon groups", the "substituted or unsubstituted heterocyclic groups" or the "substituted or unsubstituted condensed polycyclic aromatic groups" represented by $R_1$ and $R_2$ in formula (1) can be used.

As the "substituents" in the "substituted aromatic hydrocarbon groups", the "substituted heterocyclic groups" or the "substituted condensed polycyclic aromatic groups" represented by $R_5$ in formula (1), the same as those illustrated as the "substituents" in the "alkyl groups and the like having a substituent" represented by $R_1$ and $R_2$ in the above formula (1) can be used. Aspects that can be taken may also be the same as the above.

As $R_1$ in formula (1), a hydrogen atom, a deuterium atom, a hydroxyl group, a linear or branched alkyl group having 1 to 20 carbon atoms which may have a substituent, a linear or branched alkyloxy group having 1 to 20 carbon atoms which may have a substituent, and an acyl group having 2 to 6 carbon atoms which may have a substituent are preferred, a hydrogen atom, a deuterium atom, a linear or branched alkyl group having 1 to 10 carbon atoms which may have a substituent, and a linear or branched alkyloxy group having 1 to 10 carbon atoms which may have a substituent are more preferred, and a hydrogen atom, a deuterium atom, and a linear or branched alkyl group having 1 to 6 carbon atoms which may have a substituent are still more preferred. Here, as the linear or branched alkyl group having 1 to 6 carbon atoms which may have a substituent, a linear or branched alkyl group having 1 to 3 carbon atoms which does not have a substituent is more preferred.

As $R_2$ in formula (1), a hydrogen atom, a deuterium atom, a hydroxyl group, a carboxyl group, an ester group, a linear or branched alkyl group having 1 to 20 carbon atoms which may have a substituent, a cycloalkyl group having 5 to 10 carbon atoms which may have a substituent, a linear or branched alkyloxy group having 1 to 20 carbon atoms which may have a substituent, a cycloalkyloxy group having 5 to 10 carbon atoms which may have a substituent, and an acyl group having 2 to 6 carbon atoms which may have a substituent are preferred, and a hydrogen atom, a deuterium atom, a hydroxyl group, a linear or branched alkyl group having 1 to 6 carbon atoms which may have a substituent, a cycloalkyl group having 5 to 6 carbon atoms which may have a substituent, a linear or branched alkyloxy group having 1 to 6 carbon atoms which may have a substituent, a cycloalkyloxy group having 5 to 6 carbon atoms which may have a substituent, and an acyl group having 2 to 4 carbon atoms which may have a substituent are more preferred, and a hydrogen atom, a deuterium atom, a hydroxyl group, a linear or branched alkyl group having 1 to 6 carbon atoms which may have a substituent, and an acyl group having 2 to 4 carbon atoms which may have a substituent are still more preferred. Here, as the linear or branched alkyl group having 1 to 6 carbon atoms which may have a substituent, a linear or branched alkyl group having 1 to 3 carbon atoms which does not have a substituent is more preferred. Further, as the linear or branched alkyloxy group having 1 to 6 carbon atoms which may have a substituent, a linear or branched alkyloxy group having 1 to 3 carbon atoms which does not have a substituent is more preferred. Still further, as the acyl group having 2 to 4 carbon atoms which may have a substituent, an acyl group having 2 to 3 carbon atoms which does not have a substituent is more preferred.

As $R_3$ and $R_4$ in formula (1), a hydrogen atom, a deuterium atom, a linear or branched alkyl group having 1 to 20 carbon atoms which may have a substituent, a cycloalkyl group having 5 to 10 carbon atoms which may have a substituent, a substituted or unsubstituted aromatic hydrocarbon group, a substituted or unsubstituted heterocyclic group, and a substituted or unsubstituted condensed polycyclic aromatic group are preferred, a hydrogen atom, a deuterium atom, a linear or branched alkyl group having 1 to 20 carbon atoms which may have a substituent, a cycloalkyl group having 5 to 10 carbon atoms which may have a substituent, and a substituted or unsubstituted aromatic hydrocarbon group are more preferred, and a hydrogen atom, a deuterium atom, a linear or branched alkyl group having 1 to 6 carbon atoms which may have a substituent, a cycloalkyl group having 5 to 6 carbon atoms which may have a substituent, and a phenyl group that may have a substituent are still more preferable. Here, as the linear or branched alkyl group having 1 to 6 carbon atoms which may have a substituent, a linear or branched alkyl group having 1 to 3 carbon atoms which has a phenyl group as the substituent, or a linear or branched alkyl group having 1 to 3 carbon atoms which does not have a substituent is more preferred.

As $R_5$ in formula (1), a hydrogen atom, a deuterium atom, a linear or branched alkyl group having 1 to 20 carbon atoms which may have a substituent, a cycloalkyl group having 5 to 10 carbon atoms which may have a substituent, and a substituted or unsubstituted aromatic hydrocarbon group are preferred, and a hydrogen atom, a deuterium atom, a linear or branched alkyl group having 5 to 12 carbon atoms which may have a substituent, and a phenyl group that may have a substituent are more preferred. Here, as the linear or branched alkyl group having 5 to 12 carbon atoms which may have a substituent, a linear or branched alkyl group having 6 to 11 carbon atoms which does not have a substituent is more preferred.

As $R_6$ in formula (2), a substituted or unsubstituted divalent aromatic hydrocarbon group, a substituted or unsubstituted divalent heterocyclic group, and a substituted or unsubstituted divalent condensed polycyclic aromatic group are preferred, and a substituted or unsubstituted phenylene group, a substituted or unsubstituted naphthalenediyl group, a substituted or unsubstituted piperazinediyl group and as substituted or unsubstituted quinoxalinediyl group are more preferred.

Here, specific examples of the "divalent aromatic hydrocarbon group", the "divalent heterocyclic group" or the "divalent condensed polycyclic aromatic group", which are represented by $R_6$ in formula (2), include a phenylene group, a naphthalenediyl group, an anthracenediyl group, a phenanthrenediyl group, a naphthacenediyl group, a pyroldiyl group, a furandiyl group, a pyridinediyl group, a piperadinediyl group, a quinolinediyl group, and a quinoxalinediyl group.

As the "substituent" in the "divalent substituted aromatic hydrocarbon group", the "divalent substituted heterocyclic group" or the "divalent substituted condensed polycyclic aromatic group", which are represented by $R_6$ in formula (2), the same as those illustrated as the "substituent" in the "alkyl groups and the like having a substituent", which are represented by $R_1$ and $R_2$ in the above formula (1) can be used. Aspects that can be taken may also be the same as the above.

The resorcin derivative represented by formula (1) may be a resorcin derivative represented by, for example, the following formula (3) or (4).

[Chemical Formula 3]

(3)

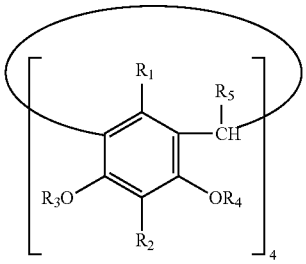

In formula (3), $R_1$s may be identical to or different from each other and represent a hydrogen atom, a deuterium atom, a linear or branched alkyl group having 1 to 10 carbon atoms which may have a substituent, or a linear or branched alkyloxy group having 1 to 10 carbon atoms which may have a substituent. $R_2$s may be identical to or different from each other and represent a hydrogen atom, a deuterium atom, a hydroxyl group, a linear or branched alkyl group having 1 to 6 carbon atoms which may have a substituent, a cycloalkyl group having 5 to 6 carbon atoms which may have a substituent, a linear or branched alkyloxy group having 1 to 6 carbon atoms which may have a substituent, a cycloalkyloxy group having 5 to 6 carbon atoms which may have a substituent, or a acyl group having 2 to 4 carbon atoms which may have a substituent. $R_3$ and $R_4$ may be identical to or different from each other and represent a hydrogen atom, a deuterium atom, a linear or branched alkyl group having 1 to 20 carbon atoms which may have a substituent, a cycloalkyl group having 5 to 10 carbon atoms which may have a substituent, or a substituted or unsubstituted aromatic hydrocarbon group. $R_5$s may be identical to or different from each other and represent a hydrogen atom, a deuterium atom, a linear or branched alkyl group having 1 to 20 carbon atoms which may have a substituent, a cycloalkyl group having 5 to 10 carbon atoms which may have a substituent, or a substituted or unsubstituted aromatic hydrocarbon group.

[Chemical Formula 4]

(4)

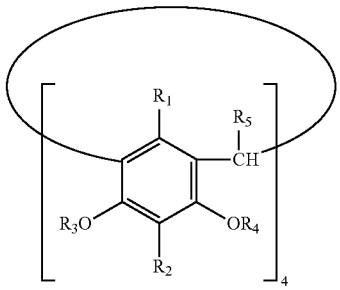

In formula (4), $R_1$s may be identical to or different from each other and represent a hydrogen atom, a deuterium atom, or a linear or branched alkyl group having 1 to 6 carbon atoms which may have a substituent. $R_2$s may be identical to or different from each other and represent a hydrogen atom, a deuterium atom, a hydroxyl group, a linear or branched alkyl group having 1 to 6 carbon atoms which may have a substituent, or a acyl group having 2 to 4 carbon atoms which may have a substituent. $R_3$ and $R_4$ may be identical to or different from each other and represent a hydrogen atom, a deuterium atom, a linear or branched alkyl group having 1 to 6 carbon atoms which may have a substituent, a cycloalkyl group having 5 to 6 carbon atoms which may have a substituent, or a phenyl group that may have a substituent. $R_5$s may be identical to or different from each other and represent a hydrogen atom, a deuterium atom, a linear or branched alkyl group having 5 to 12 carbon atoms which may have a substituent, or a phenyl group that may have a substituent.

The resorcin derivatives represented by formula (1) may be, as described above, resorcin derivatives represented by the following formula (2).

[Chemical Formula 5]

(2)

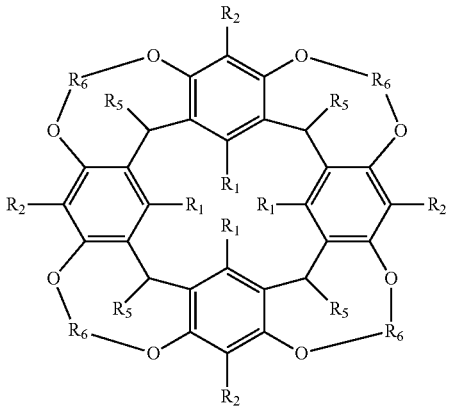

In formula (2), $R_1$ and $R_2$ may be identical to or different from each other and represent a hydrogen atom, a deuterium atom, a halogen atom, a hydroxyl group, a nitro group, a carboxyl group, an ester group, a linear or branched alkyl group having 1 to 20 carbon atoms which may have a substituent, a cycloalkyl group having 5 to 10 carbon atoms which may have a substituent, a linear or branched alkyloxy group having 1 to 20 carbon atoms which may have a substituent, a cycloalkyloxy group having 5 to 10 carbon atoms which may have a substituent, an acyl group having 2 to 6 carbon atoms which may have a substituent, a substituted or unsubstituted aromatic hydrocarbon group, a substituted or unsubstituted heterocyclic group, or a substituted or unsubstituted condensed polycyclic aromatic group. $R_5$s may be identical to or different from each other and represent a hydrogen atom, a deuterium atom, a linear or branched alkyl group having 1 to 20 carbon atoms which may have a substituent, a cycloalkyl group having 5 to 10 carbon atoms which may have a substituent, a substituted or unsubstituted aromatic hydrocarbon group, a substituted or unsubstituted heterocyclic group, or a substituted or unsubstituted condensed, polycyclic aromatic group. $R_6$s may be identical to or different from each other and represent a divalent group which is formed by mutual binding of $R_3$ and $R_4$ via a single bond. $R_3$ and $R_4$ may be identical to or different from each other and represent a hydrogen atom, a deuterium atom, a linear or branched alkyl group having 1 to 20 carbon atoms which may have a substituent, a cycloalkyl group having 5 to 10 carbon atoms which may have a substituent, a substituted or unsubstituted aromatic hydrocarbon group, a substituted or unsubstituted heterocyclic group, or a substituted or unsubstituted condensed polycyclic aromatic group.

The resorcin derivative represented by formula (2) may be, for example, a resorcin derivative represented by the following formula (5) or (6).

[Chemical Formula 6]

(5)

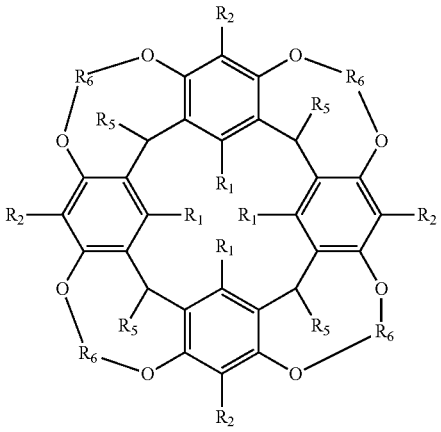

in formula (5), $R_1$s may be identical to or different from each other and represent a hydrogen atom, a deuterium atom, a linear or branched alkyl group having 1 to 10 carbon atoms which may have a substituent, or a linear or branched alkyloxy group having 1 to 10 carbon atoms which may have a substituent. $R_2$s may be identical to or different from each other and represent a hydrogen atom, a deuterium atom, a hydroxyl group, a linear or branched alkyl group having 1 to 6 carbon atoms which may have a substituent, a cycloalkyl group having 5 to 6 carbon atoms which may have a substituent, a linear or branched alkyloxy group having 1 to 6 carbon atoms which may have a substituent, a cycloalkyloxy group having 5 to 6 carbon atoms which may have a substituent, or a acyl group having 2 to 4 carbon atoms which may have a substituent. $R_5$s may be identical to or different from each other and represent a hydrogen atom, a deuterium atom, substituenta linear or branched alkyl group having 1 to 20 carbon atoms which may have a substituent, substituenta cycloalkyl group having 5 to 10 carbon atoms which may have a substituent, or a substituted or unsubstituted aromatic hydrocarbon group, and $R_6$s may be identical to or different from each other and represent a substituted or unsubstituted divalent aromatic hydrocarbon group, a substituted or unsubstituted divalent heterocyclic group, or a substituted or unsubstituted divalent condensed polycyclic aromatic group.

[Chemical Formula 7]

(6)

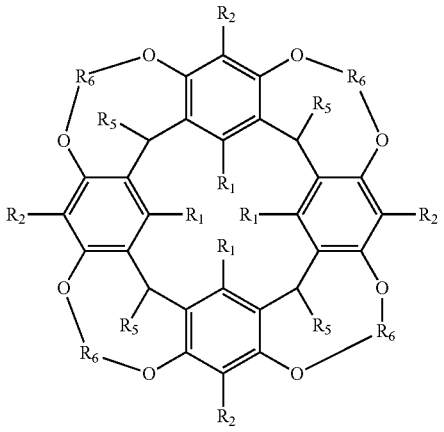

In formula (6), $R_1$s may be identical to or different from each other and represent a hydrogen atom, a deuterium atom, or a linear or branched alkyl group having 1 to 6 carbon atoms which may have a substituent, $R_2$s may be identical to or different from each other and represent a hydrogen atom, a deuterium atom, a hydroxyl group, a linear or branched alkyl group having 1 to 6 carbon atoms which may have a substituent, or an acyl group having 2 to 4 carbon atoms which may have a substituent, $R_5$s may be identical to or different from each other and represent a hydrogen atom, a deuterium atom, a linear or branched alkyl group having 5 to 12 carbon atoms which may have a substituent, or a phenyl group that may have a substituent, and $R_6$s may be identical to or different from each other and represent a substituted or unsubstituted phenylene group, a substituted or unsubstituted naphthalenediyl group, a substituted or unsubstituted piperazinediyl group, or a substituted or unsubstituted quinoxalinediyl group.

The resorcin derivatives represented by formula (1) can be produced according to a known method. For example, a resorcin derivative used in the present invention can be synthesized by a corresponding resorcin compound and a corresponding aldehyde reacting under the presence of hydrochloric acid or the like.

Specific examples of preferable compounds among the resorcin derivatives represented by formula (1) will be shown below. However, the present invention is not limited to these compounds. It should be noted that hydrogen atoms are partially omitted in the following structural formulae.

Further, even when there are stereoisomers, their planar structural structures are described.

[Chemical Formula 8]

(Compound 1)

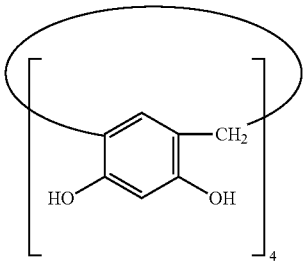

[Chemical Formula 9]

(Compound 2)

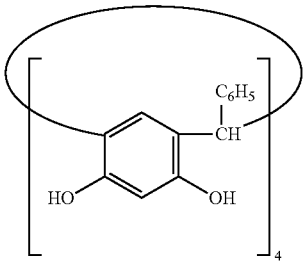

[Chemical Formula 10]

(Compound 3)

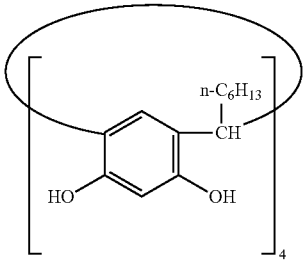

[Chemical Formula 11]

(Compound 4)

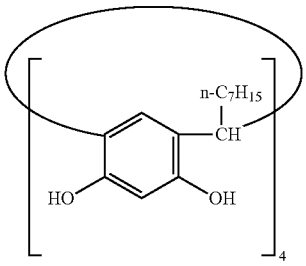

[Chemical Formula 12]

(Compound 5)

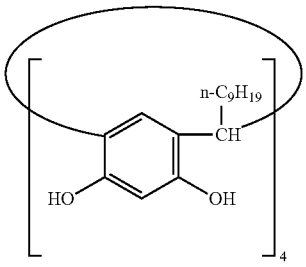

-continued

[Chemical Formula 13]

(Compound 6)

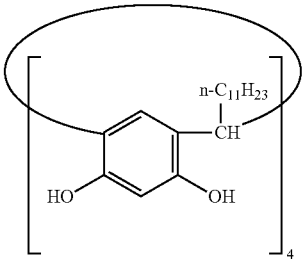

[Chemical Formula 14]

(Compound 7)

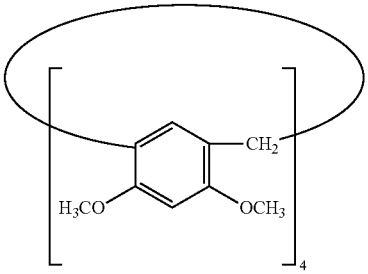

[Chemical Formula 15]

(Compound 8)

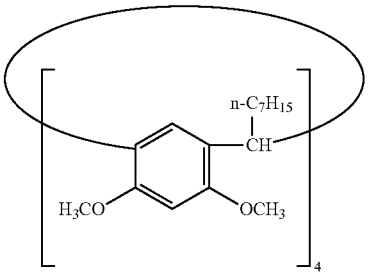

[Chemical Formula 16]

(Compound 9)

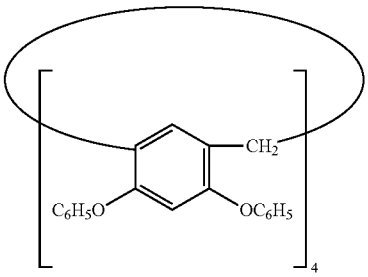

[Chemical Formula 17]

(Compound 10)

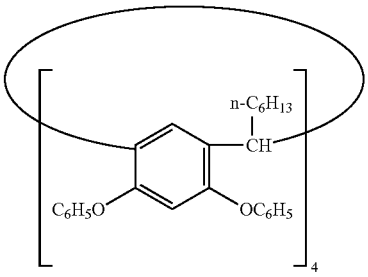

-continued
[Chemical Formula 18]
(Compound 11)
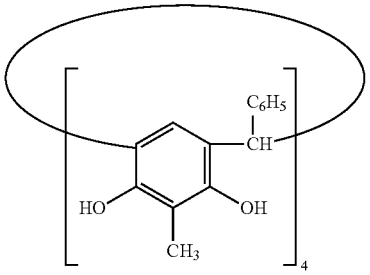
[Chemical Formula 19]
(Compound 12)
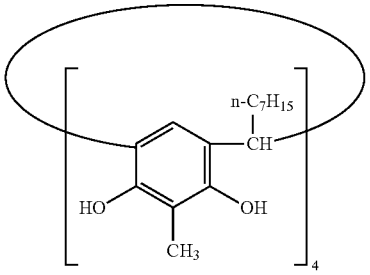
[Chemical Formula 20]
(Compound 13)
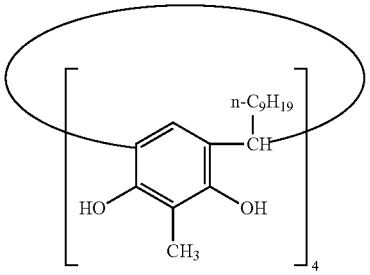
[Chemical Formula 21]
(Compound 14)
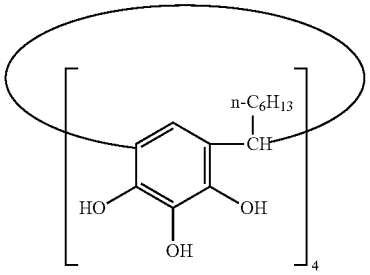
[Chemical Formula 22]
(Compound 15)
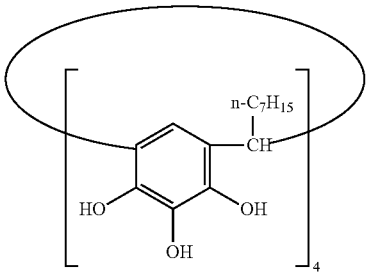
-continued
[Chemical Formula 23]
(Compound 16)
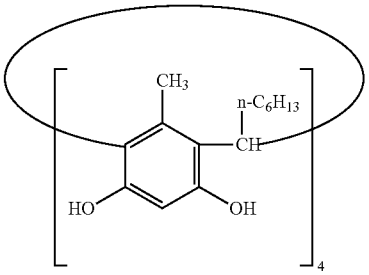
[Chemical Formula 24]
(Compound 17)
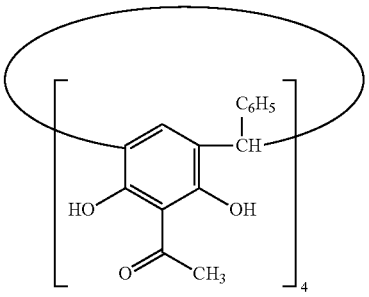
[Chemical Formula 25]
(Compound 18)
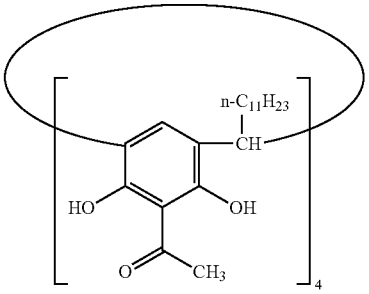
[Chemical Formula 26]
(Compound 19)
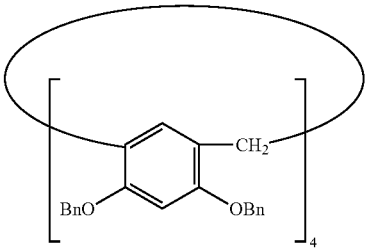
[Chemical Formula 27]
(Compound 20)
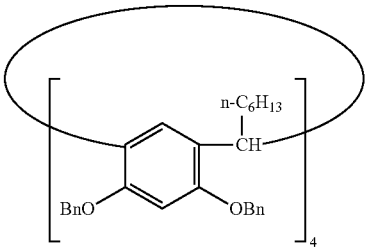

-continued
[Chemical Formula 28]
(Compound 21)
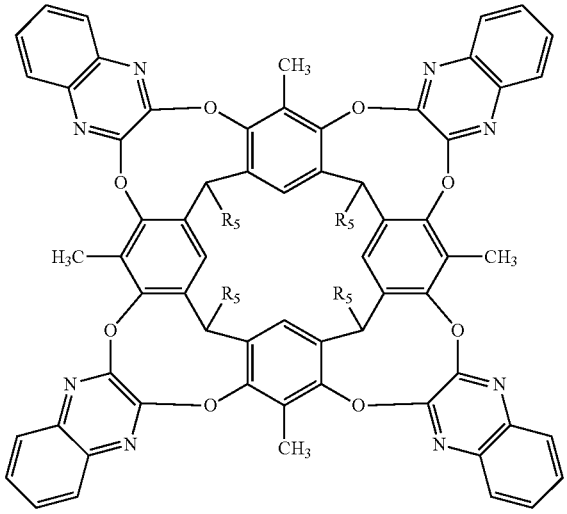
$R_5$ = n-$C_7H_{15}$
[Chemical Formula 29]
(Compound 22)
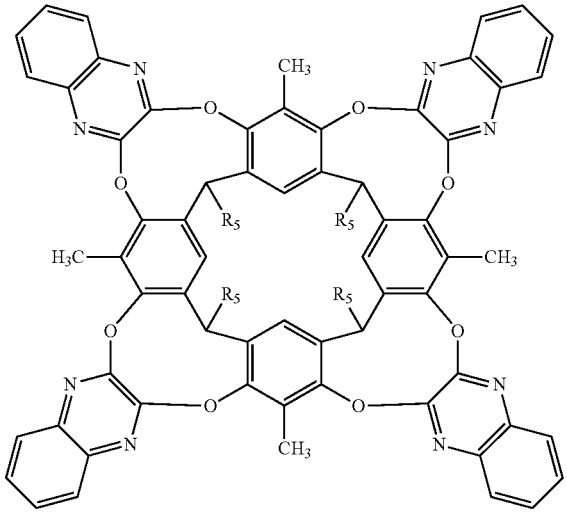
$R_5$ = n-$C_9H_{19}$
-continued
[Chemical Formula 30]
(Compound 23)
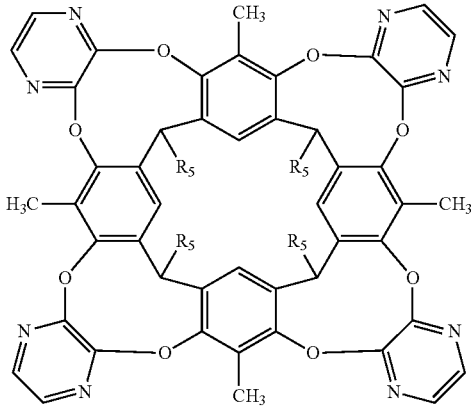
$R_5$ = n-$C_7H_{15}$
[Chemical Formula 31]
(Compound 24)
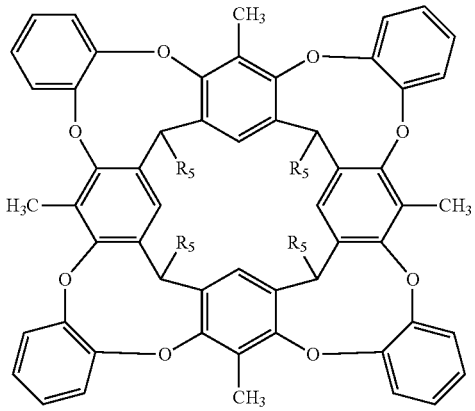
$R_5$ = n-$C_6H_{13}$
[Chemical Formula 32]
(Compound 25)
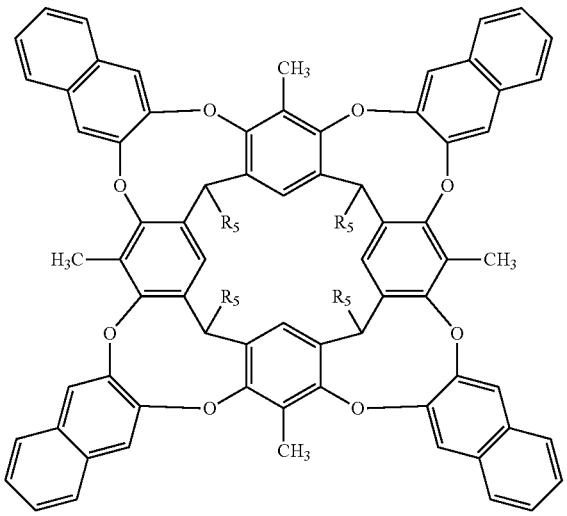
$R_5$ = $C_6H_5$ The above resorcin derivatives may be used singularly or in a combination of two or more kinds thereof.

The charge control agent of the invention is preferably used by controlling a volume average particle size within the range of 0.1 to 20 μm, and more preferably within the range of 0.1 to 10 μm. When the volume average particle size is smaller than 0.1 μm, there is a tendency that an intended charge control effect becomes difficult to obtain because the relevant charge control agent appearing on a surface of the toner becomes remarkably slight. By contrast, when it is larger than 20 μm, there is a tendency that charge control agent that falls off the toner increases which likely results in an adverse effect such as intra-apparatus contamination.

When the charge control agent of the invention is used in a polymerization toner, the volume average particle size thereof is preferably controlled to not larger than 1.0 μm and more preferably to 0.01 to 1.0 μm. When the volume average particle size exceeds 1.0 μm, performance or reliability may be degraded because a particle size distribution of the finally obtained toner becomes broader or free particles are generated. On the other hand, when the volume average particle size is within the above range, in addition to there being no such defect, it is advantageous that deflection between toners decreases and the dispersion in the toner is excellent, and variation of the performance and reliability becomes smaller. It should be noted that the volume average particle size of the charge control agent means an average particle size on a volume basis in a measurement that uses a laser type particle size distribution analyzer (for example, Laser Micronsizer manufactured by Seishin Enterprise Co., Ltd.).

As a method that makes the toner contain the present charge control agent, there is a method of adding the agent to the inside of the toner particles (internal addition) and a method of adding the agent to the surface of the toner particles (external addition), and both can use known methods without limitation. As a specific example of the method of adding to the inside of the toner particles, a method in which the present charge control agent is added to a binder resin together with a colorant and the like and the mixture is kneaded and pulverized to obtain a toner (pulverization method), or a method in which the charge control agent of the invention is added to a polymerizable monomer to polymerize a toner (polymerization method) can be used. In the case of internal addition, the charge control agent of the invention is preferably added in an amount of from 0.1 to 10 parts by mass with respect to 100 parts by mass of the binder resin and more preferably in an amount of from 0.2 to 5 parts by mass. In the case of external addition, the charge control agent of the invention is preferably added in an amount of from 0.01 to 5 parts by mass with respect to 100 parts by mass of the binder resin and more preferably in an amount of from 0.01 to 2 parts by mass. Further, it is preferable to mechanochemically fix the charge control agent of the invention on the surface of the toner particles.

The charge control agent of the invention can be used together with known another negatively charged charge control agent in the toner of the invention. Examples of the other charge control agent that can be used together include, for example, an azo based iron complex or a complex salt, an azo based chromium complex or a complex salt, an azo based manganese complex or a complex salt, an azo based cobalt complex or a complex salt, an azo based zirconium complex or a complex salt, a chromium complex of a carboxylic acid derivative or a complex salt, a zinc complex of a carboxylic acid derivative or a complex salt, an aluminum complex of a carboxylic acid derivative or a complex salt, a zirconium complex of a carboxylic acid derivative or a complex salt, a boron complex or a complex salt, or a negatively charged resin charge control agent. As the carboxylic acid derivative, an aromatic hydroxycarboxylic acid is preferable and 3,5-di-tert-butyl salicylic acid is further preferable.

When the charge control agent of the invention and another known negatively charged charge control agent are used together in the present toner, the charge control agent other than the charge control agent of the invention is preferably added in an amount of from 0.1 to 10 parts by mass with respect to 100 parts by mass of the binder resin.

The charge control agent of the invention is also preferable as the charge control agent (charge enhancement agent) in a coating material for electrostatic powder coating. That is, the coating material for electrostatic coating which uses the charge enhancement agent has excellent environment resistance, storage stability, in particular, thermal stability and endurance, has coating efficiency of 100%, and can form a thick film free from coating defects.

(Binder Resin)

As the binder resin, any binder resin can be used as long as it is known in the art. Examples of the binder resin include vinyl polymers such as a styrene monomer, an acrylate monomer, and a methacrylate monomer, or copolymers made of two or more of these monomers, a polyester polymer, a polyol resin, a phenol resin, a silicone resin, a polyurethane resin, a polyamide resin, a furan resin, an epoxy resin, a xylene resin, a terpene resin, a coumarone-indene resin, a polycarbonate resin and a petroleum resin.

Examples of the styrene monomer include styrenes such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene or derivatives thereof.

Examples of the acrylate monomer include acrylic acids such as acrylic acid, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate or acrylic esters thereof.

Examples of the methacrylate monomer include methacrylic acids such as methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate or methacrylic esters thereof.

As examples of other monomers that form the above-described vinyl polymers or copolymers, the following (1) to (18) can be used. (1) Mono-olefins such as ethylene, propylene, butylene and isobutylene; (2) polyenes such as butadiene, and isoprene; (3) vinyl halides such as vinyl chloride, vinylidene chloride, vinyl bromide, and vinyl fluoride; (4) vinyl esters such as vinyl acetate, vinyl propionate, and vinyl benzoate; (5) vinyl ethers such as vinylmethylether, vinylethylether, and vinylisobutylether; (6) vinyl ketones such as methyl vinyl ketone, hexyl vinyl ketone, and methyl isopropenyl ketone; (7) N-vinyl compounds such as N-vinylpyrol, N-vinyl carbazole, N-vinylindole and N-vinylpyrrolidone; (8) vinyl naphthalenes; (9) acrylic acids or methacrylic acid derivatives such as acrylonitrile, methacrilonitrile and acryl amide; (10) unsaturated dibasic acids such as maleic acid, citraconic acid, itaconic acid, alkenyl succinic acid, fumaric acid, and mesaconic acid; (11) unsaturated dibasic acid anhydrides such as maleic anhydride, citraconic anhydride, itaconic anhydride and alkenylsuccinic anhydride; (12) unsaturated dibasic acid monoesters such as maleic acid monomethyl ester, maleic acid monoethyl ester, maleic acid monobutyl ester, citraconic acid monomethyl ester, citraconic acid monoethyl ester, citraconic acid monobutyl ester, itaconic acid monomethyl ester, alkenyl succinic acid monomethyl ester, fumaric acid monomethyl ester, and mesaconic acid monomethyl ester; (13) unsaturated dibasic acid esters such as dimethyl maleic acid and dimethyl fumaric acid; (14) alfa, beta-unsaturated acids such as chrotonic acid and cinnamic acid; (15) alfa, beta-unsaturated acid anhydrides such as chrotonic anhydride and cinnamic anhydride; (16) monomers having a carboxylic group such as mixed acid anhydrides of alfa, beta-unsaturated acids and lower fatty acids, alkenyl malonic acid, alkenyl glutaric acid, alkenyl adipic acid, acid anhydrides thereof, and monoesters thereof; (17) acrylic or methacrylic acid hydroxyl alkyl esters such as 2-hydroxyethyl acrylate, 2-hydroxyethyl methacrylate and 2-hydroxypropyl methacrylate; and (18) monomers having a hydroxy group such as 4-(1-hydroxy-1-methylbutyl)styrene and 4-(1-hydroxy-1-methylhexyl)styrene.

The above-described vinyl polymers or copolymers may have a crosslinked structure bridged by a cross-linking agent having two or more vinyl groups. Examples of the cross-linking agent having two or more vinyl groups include aromatic divinyl compounds such as divinyl benzene and divinyl naphthalene; diacrylate compounds or corresponding dimethacrylate compounds such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate; and diacrylate compounds of alkylene dials such as diethylene glycol diacrylate, triethylene glycol diacrylate, tetraethylene glycol diacrylate, polyethylene glycol #400 diacrylate, polyethylene glycol #600 diacrylate, and dipropylene glycol diacrylate or corresponding dimethacrylate compounds thereof.

Other than the above, diacrylate compounds connected by a chain containing an aromatic group and an ether bond, or corresponding dimethacrylate compounds, and polyester diacrylates (for example, Product Name: MANDA, manufactured by Nippon Kayaku Co., Ltd.) can be used.

Examples of a polyfunctional crosslinking agent include acrylate compounds such as pentaerythritol triacrylate, trimethylol ethane triacrylate, trimethylol propane triacrylate, tetramethylol methane tetracrylate, and oligoester acrylates, or corresponding methacrylate compounds, triallylcyanulate, and triallyl trimellitate.

These crosslinking agents are preferably used in an amount of from 0.01 to 10 parts by mass and more preferably in an amount of from 0.03 to 5 parts by mass with respect to 100 parts by mass of other monomer components. Among these crosslinking agents, as those that can be suitably used in a toner resin from the viewpoint of fixing properties and offset resistance, diacrylate compounds connected by a joining chain containing an aromatic divinyl compound (divinyl benzene is particularly preferable), an aromatic group and an ether bond can be used. Among these, combinations of monomers that form styrene copolymers or styrene-acrylate copolymers are preferable.

Examples of a polymerization initiator that is used to manufacture the above-described vinyl polymers or copolymers include ketone peroxides such as 2,2'-azobisisobutyllonitrile, 2,2'-azobis(4-methoxy-2, 4-dimethylvallelonitrile), 2,2'-azobis(2, 4-dimethylvallelonitrile), 2,2'-azobis(2-methylbutylonitrile), dimethyl-2,2'-azobisisobutylate, 1,1'-azobis(1-cyclohexanecarbonitrile), 2-(carbamoylazo)-isobutyllonitrile, 2,2'-azobis(2,4,4-trimethylpentane), 2-phenylazo-2',4'-dimethyl-4-methoxyvallelonitrile, 2,2'-azobis(2-methylpropane), methyl ethyl ketone peroxide, acetyl acetone peroxide, and cyclohexanone peroxide; 2,2-bis(tert-butylperoxy)butane, tert-butylhydroperoxide, cumene hydroperoxide, 1,1,3,3-tetramethylbutyl hydroperoxide, di-tert-butyl peroxide, tert-buylcumyl peroxide, dicumylperoxide, alpha-(tert-butylperoxy)isopropyl benzene, isobutyl peroxide, octanoyl peroxide, decanoyl peroxide, lauloyl peroxide, 3,5,5-trimethyl hexanoyl peroxide, benzoyl peroxide, m-tolyl peroxide, diisopropyl peroxy dicarbonate, di-2-ethylhexyl peroxy dicarbonate, di-n-propyl peroxydicarbonate, di-2-ethoxy ethylperoxy carbonate, diethoxy isopropyl peroxy dicarbonate, bis(3-methyl-3-methoxybutyl)peroxy carbonate, acetyl cyclohexylsulphonyl peroxide, tert-butyl peroxyacetate, tert-butyl peroxyisobutylate, tert-butylperoxy-2-ethylhexanoate, tert-butyl peroxylaurate, tert-butylperoxy benzoate, tert-butylperoxyisopropylcarbonate, di-tert-butyl peroxyisophthalate, tert-butyl peroxyallyl carbonate, isoamyl peroxy-2-ethylhexanoate, di-tert-butyl peroxyhexahydroterephthalate, and tert-butylperoxy azelate.

In the case where the binder resin is a styrene-acrylate resin, when a molecular weight distribution of a component soluble in tetrahydrofuran (hereinafter, referred to as "THF") of a resin component is measured by gel permeation chromatography (hereinafter, referred to as "GPC"), a binder resin that has at least one peak in the region of a molecular weight of from 3,000 to 50,000 (in terms of number average molecular weight) and at least one peak in the region of molecular weight of 100,000 or more is preferred from the viewpoint of fixing property, offset resistance and storage property. A binder resin is preferred in which the component having a molecular weight of 100,000 or less is 50 to 90% in a TEE soluble component molecular distribution, and it is more preferable to have a main peak in the region of molecular weight of 5,000 to 30,000 and particularly preferable to have a main peak in the region of molecular weight of from 5,000 to 20,000.

When the binder resin is a vinyl polymer such as the styrene-acrylate resin, its acid value is preferably 0.1 to 100 mg KOH/g, more preferably 0.1 to 70 mg KOH/g, and particularly preferably 0.1 to 50 mg KOH/g. It should be noted that acid value means a mass of potassium hydroxide necessary to neutralize free fatty acid in 1 g of the binder resin and is measured in accordance with JIS K-0070.

As the monomer that constitutes a polyester polymer, the following can be used. Examples of a divalent alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, or a diol obtained by polymerizing a cyclic ether such as ethylene oxide or propylene oxide with bisphenol A.

An alcohol of trivalence or more is preferably used together to crosslink a polyester resin. Examples of the polyalcohol of trivalence or more include sorbitol, 1, 2, 3, 6-hexanetetrol, 1,4-sorbitan, pentaerythritol, dipentaerythritol, tripentaerythritol, 1, 2, 4-butanetriol, 1, 2, 5-pentatriol, glycerol, 2-methylpropanetriol, 2-methyl-1, 2, 4-butanetriol, trimethylol ethane, trimethylol propane, and 1, 3, 5-trihydroxybenzene.

As an acid component that forms a polyester polymer, benzene dicarboxylic acids such as phthalic acid, isophthalic acid, and terephthalic acid and anhydrides thereof; alkyldicarboxylic acids such as succinic acid, adipic acid, sebacic acid, and azelaic acid or anhydrides thereof; unsaturated dibasic acids such as maleic acid, citraconic acid, itaconic acid, alkenyl succinic acid, fumaric acid, and mesaconic acid or anhydrides thereof can be used. Further, as a polycarboxylic acid component of trivalence or more, trimellitic acid, pyromellitic acid, 2, 5, 7-naphthalene tricarboxylic acid, 1, 2, 4-naphthalene tricarboxylic acid, 1, 2, 4-butanetricarboxylic acid, 1, 2, 5-hexanetricarboxylic acid, 1, 3-dicarboxy-2-methyl-2-methylenecarboxypropane, tetra(methylenecarboxy)methane, 1, 2, 7, 8-octanetetracarboxylic acid, trimer acid or anhydrides thereof, and partial lower alkyl esters thereof can be used.

When the binder resin is a polyester resin, the polyester resin has preferably at least one peak in the region of the molecular weight of from 3,000 to 50,000 in the molecular weight distribution of the THF soluble component of the resin component from the viewpoint of the fixing property and offset resistance of the toner, further, in the molecular weight distribution of the THF soluble component, a binder resin is preferred in which the component of the molecular weight of 10,000 or less is 60 to 100%, and a binder resin having at least one peak in the region of the molecular weight of from 5,000 to 20,000 is more preferred. In the present invention, the molecular weight distribution of the binder resin is measured by GPC with THF as a solvent. The above-described molecular weight is a number average molecular weight in terms of reference polystyrene measured by, for example, HLC-8220GPC apparatus (manufactured by Tosoh Corporation).

When the binder resin is a polyester resin, its acid value is preferably 0.1 to 100 mg KOH/g, more preferably 0.1 to 70 mg KOH/g, and particularly preferably 0.1 to 50 mg KOH/g. Further, a hydroxyl value is preferably 30 mg KOH/g or less and more preferably 10 to 25 mg KOH/g. It should be noted that hydroxyl value means a mass of potassium hydroxide necessary to neutralize acetic acid generated when hydroxyl groups in 1 g of the binder resin are acetylated with acetic anhydride and is measured in accordance with JIS K-0070.

An amorphous polyester resin and two or more crystalline polyester resins may be used in a combination. In this case, it is preferable to select materials by considering respective solubility. As the amorphous polyester resin, those synthesized from a polyvalent carboxylic acid component, preferably, an aromatic polyvalent carboxylic acid and a polyvalent alcohol component are preferably used, and, as the crystalline polyester resin, those synthesized from a divalent carboxylic acid component, preferably, an aliphatic dicarboxylic acid and a divalent alcohol component can be preferably used.

As the binder resin, a resin that contains, in the vinyl polymer component and/or polyester resin component, a monomer component capable of reacting with both of the resin components can also be used. Examples of those that can react with the vinyl polymer among the monomers that constitute the polyester resin component include unsaturated dicarboxylic acid such as phthalic acid, maleic acid, citraconic acid, and itaconic acid or anhydrides thereof. As the monomers that constitute the vinyl polymer components, those having a carboxyl group or a hydroxyl group, and acrylic acid or methacrylic acid esters can be used. Furthermore, in the case that a polyester polymer, a vinyl polymer and another binder resin are used in combination, the containing amount of the binder resins is 60 mass % or more preferably, the acid value of all of which is 0.1 to 50 mg KOH/g.

In the present specification, the acid value of the binder resin, is obtained by the following method and fundamental operations are performed in accordance with JIS K-0070.

(1) A sample is used by removing, in advance, additives other than a binder resin (polymer component), or acid values and contents of components other than the binder resin and a crosslinked binder resin are obtained in advance. Then, 0.5 to 2.0 g of pulverized sample is weighted precisely, and a weight of the polymer component is set to Wg. For example, when the acid value of the binder resin is measured from the toner, acid values and contents of a colorant or a magnetic substance are separately measured, and the acid value of the binder resin is obtained by calculation.

(2) The sample is charged in a 300 (ml) beaker and is dissolved by adding 150 (ml) of a mixed solution of toluene/ethanol (volume ratio: 4/1).

(3) Using an ethanol solution of OA mol/l of KOH, titration is performed by means of a potentiometric titrator.

(4) An amount of potassium hydroxide solution used at this time is set to S (ml), simultaneously a blank is measured and an amount of potassium hydroxide solution used at this time is set to B (ml), and the acid value is calculated according to the following formula. Here, f is a factor of potassium hydroxide concentration.

$$\text{Acid value (mg KOH/g)}=[(S-B)\times f\times 5.61]/W$$

The binder resin of a toner and a composition containing the binder resin preferably have a glass transition temperature (Tg) of from 35 to 80° C. and more preferably have a glass transition temperature of from 40 to 75° C. in terms of preserving the toner. When the Tg is lower than 35° C., the toner tends to degrade under a high temperature atmosphere, and offset tends to occur during fixing. Further, when the Tg is higher than 80° C., the fixing property tends to decrease.

In the polymerization toner of the invention, a binder resin having a softening temperature of 80 to 140° C. is preferably used. When the softening temperature of the binder resin is lower than 80° C., the toner after fixing and during storage, and image stability of the toner, may degrade. On the other hand, when the softening temperature exceeds 140° C., the low temperature fixing property may degrade.

[Colorant]

As a colorant, well-known colorants can be used without limitation. In the case of a black toner, as a colorant, for example, black or blue dyes such as an azo dye, an anthraquinone dye, a xanthine dye, and a methine dye, or black or blue pigments such as carbon black, aniline black, acetylene black, phthalocyanine blue, and indanthrene blue can be used.

In the case of a color toner, as the colorant, the following can be illustrated. Examples of a magenta colorant include a condensed azo compound, a diketopyrrolopyrrole compound, an anthraquinone compound, a quinacridone compound, a basic dye, a lake dye, a naphthol dye, a benzimidazolone compound, a thioindigo compound and a perylene compound. Specific examples of a pigment type magenta colorant include C.I. Pigment Reds 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Vat Reds 1, 2, 10, 13, 15, 23, 29, 35. These pigments may be used alone but are desirably used in combination with a dye from the viewpoint of improving sharpness of an image.

Examples of a dye type magenta colorant include oil-soluble dyes such as C.I. Solvent Reds 1, 3, 8, 23, 24, 25, 27, 30, 49, 81, 82, 83, 84, 100, 109 and 121; C.I. Disperse Red 9; C.I. Solvent Violets 8, 13, 14, 21, 27; and C.I. Disperse Violet 1, as well as basic dyes such as C.I. Basic Reds 1, 2, 9, 12, 13, 14, 15, 17, 18, 22, 23, 24, 27, 29, 32, 34, 35, 36, 37, 38, 39, 40; and C.I. Basic Violets 1, 3, 7, 10, 14, 15, 21, 25, 26, 27 and 28.

As a cyan colorant, a copper phthalocyanine compound and derivatives thereof, anthraquinone and a basic dye lake compound can be used. Specific examples of a pigment type cyan colorant include C.I. Pigment Blues 2, 3, 15, 16, 17; C.I. Vat Blue 6; C.I. Acid Blue 45; and a copper phthalocyanine pigment with its phthalocyanine skeleton substituted with 1 to 5 phthalimidemethyl groups.

As a yellow colorant, a condensed azo compound, an isoindolinone compound, an anthraquinone compound, an azo metal complex, a methine compound and an allylamide compound can be used. Specific examples of a pigment yellow colorant include C.I. Pigment Yellows 1, 2, 3, 4, 5, 6, 7, 10, 11, 12, 13, 14, 15, 16, 17, 23, 65, 73, 83; and C.I. Vat Yellows 1, 3, 20.

As an orange color pigment, red chrome yellow, molybdenum orange, Permanent Orange GTR, Pyrazolone Orange, Vulcan Orange, Benzidine Orange G, Indanthrene Brilliant Orange RK and Indanthrene Brilliant Orange GK can be used. Specific examples of a violet pigment include manganese violet, Fast Violet B and Methyl Violet Lake. As a green pigment, chromium oxide, chromium green, pigment green, Malachite Green Lake and Final Yellow Green G can be used. As a white pigment, zinc white, titanium oxide, antimony white and zinc sulfide can be used.

The above-described colorants may be used alone or in a combination of two or more kinds thereof. The colorant is preferably added in an amount of from 0.1 to 20 parts by mass with respect to 100 parts by mass of the binder resin.

[Magnetic Substance]

The toner of the invention may further include a magnetic substance. Examples of a magnetic substance include magnetic iron oxides such as magnetite, maghemite and ferrite, as well as iron oxides further containing other metal oxides; metals such as iron, cobalt and nickel, or alloys of these metals with metals such as aluminum, cobalt, copper, lead, magnesium, tin, zinc, antimony, beryllium, bismuth, cadmium, calcium, manganese, selenium, titanium, tungsten and vanadium.

Specific examples of a magnetic substance include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder and nickel powder. Among these, a fine powder of $Fe_3O_4$ or $\gamma$-$Fe_2O_3$ is preferable.

Further, as a magnetic substance, magnetic iron oxide such as magnetite, maghemite or ferrite containing a xenogeneic element, or mixtures thereof can be used. Specific examples of the xenogeneic element include lithium, beryllium, boron, magnesium, aluminum, silicon, phosphorus, germanium, zirconium, tin, sulfur, calcium, scandium, titanium, vanadium, chromium, manganese, cobalt, nickel, copper, zinc and gallium. Among these, a xenogeneic element selected from magnesium, aluminum, silicon, phosphorus and zirconium is preferable. The xenogeneic element may be taken into the crystal lattice of the iron oxide, may be taken into the iron oxide in the form of an oxide, or may be on the surface of the iron oxide in the form of oxide or hydroxide. However, the element is preferably taken into the inside of iron oxide as an oxide.

The above xenogeneic element can be taken into particles by mixing a salt of the xenogeneic element with the particles and by adjusting the pH thereof at the time of forming a magnetic substance. Alternatively, by adjusting the pH after magnetic particles have been formed, or by adjusting the pH by adding each salt of the xenogeneic elements, the xenogeneic element can be precipitated on a surface of the particles.

The above magnetic substances may be used alone or in a combination of two or more kinds thereof. A content of the magnetic substance is preferably 10 to 200 parts by mass and more preferably 20 to 150 parts by mass with respect to 100 parts by mass of the binder resin. A number average particle size of the magnetic substance is preferably 0.1 to 2 μm and, more preferably 0.1 to 0.5 μm. The number average particle size can be determined by using a digitizer or the like from a photograph taken on an enlarged scale by using a transmission electron microscope.

It is preferred that the magnetic substance has such magnetic properties as a coercive force of 20 to 150 oersteds, a saturation magnetization of 50 to 200 emu/g and a residual magnetization of 2 to 20 emu/g under application of 10 K-oersteds. The above magnetic substances can also be used as the colorant.

(Wax)

The toner of the invention may further contain a wax. Examples of the wax include aliphatic hydrocarbon waxes such as a low molecular weight polyethylene, a low molecular weight polypropylene, a polyolefin wax, a microcrystalline wax, a paraffin wax and Sasol wax; oxides of aliphatic hydrocarbon waxes such as polyethylene wax oxide or block copolymers thereof; plant waxes such as candelilla wax, carnauba wax, Japanese wax, and jojoba wax; animal waxes such as beeswax, lanolin, and spermaceti; ore waxes such as ozokerite, ceresin, and petrolatum; a wax having a fatty acid ester such as montanic acid ester wax or castor wax as a main component; and a wax in which a part or all of a fatty acid ester has been deoxidized such as deoxidized carnauba wax.

Examples of the wax further include linear saturated fatty acids such as palmitic acid, stearic acid and montanic acid or linear alkylcarboxylic acids further having a linear alkyl group; unsaturated fatty acids such as brassidic acid, eleostearic acid and parinnaric acid; saturated alcohols such as stearyl alcohol, eicosyl alcohol, behenyl alcohol, carnaubyl alcohol, ceryl alcohol and melissyl alcohol, or long-chain alkyl alcohol; polyhydric alcohols such as sorbitol; fatty acid amides such as linolic acid amide, oleic acid amide, and lauric acid amide; saturated fatty acid bisamides such as methylenebiscapric acid amide, ethylenebislauric acid amide, and hexamethylenebisstearic acid amide; unsaturated fatty amides such as ethylenebisoleic acid amide, hexamethylenebisoleic acid amide, N,N-di-oleyladipic acid amide and N,N-dioleylcebacic acid amide; aromatic bisamides such as m-xylenebisstearic acid amide and N,N-distearylisophthalic acid amide; fatty acid metal salts such as calcium stearate, calcium laurate, zinc stearate, and magnesium stearate; waxes obtained by grafting vinyl monomers such as styrene and acrylate onto aliphatic hydrocarbon waxes; partially esterified compounds of fatty acids such as behenic acid monoglyceride with polyhydric alcohol; and methyl ester compounds having a hydroxyl group, obtained by hydrogenation of vegetable fats and oils.

Examples of preferable waxes include polyolefins obtained by radically polymerizing olefins under a high pressure; polyolefins obtained by refining low molecular weight byproducts obtained during polymerization of a high molecular weight polyolefin; polyolefins obtained by polymerizing using a catalyst such as a Ziegler catalyst or a metallocene catalyst under a low pressure; polyolefins obtained by polymerizing using radiation, electromagnetic waves or light; low molecular weight polyolefins obtained by pyrolyzing a high-molecular weight polyolefin; paraffin waxes, microcrystalline waxes, and Fisher Tropsch waxes; synthesized hydrocarbon waxes synthesized by using a synthol method, a hydro-call method or an Arge method; synthesized waxes prepared with a $C_1$ compound as a monomer, hydrocarbon waxes having a functional group such as a hydroxyl group or a carboxyl group; mixtures of the hydrocarbon wax and the hydrocarbon wax having a functional group; and waxes obtained by graft modifying these waxes as a matrix with a vinyl monomer such as styrene, maleic ester, acrylate, methacrylate, or maleic anhydride.

Further, those in which molecular weight distributions of these waxes are sharpened by a press perspiration method, a solvent method, a recrystallization method, a vacuum distillation method, an extraction method using a supercritical gas, or a solution segregation method, or also those obtained by removing impurities such as low molecular weight solid fatty acids, low molecular weight solid alcohols, and low molecular weight solid compounds and others can be preferably used.

Further, when two or more kinds of waxes are used together, a plasticizing effect and a mold releasing effect which are effects of wax can be simultaneously developed. Examples of a wax having the plasticizing effect include a low melting point wax, a wax having a branched molecular structure, or a wax having a polar group. Examples of a wax having the mold releasing effect include a high melting point wax, a wax having a linear structure, or a nonpolar wax that does not have a functional group. Examples of use include a combination of two or more kinds of waxes whose melting point difference is from 10° C. to 100° C. and a combination of a polyolefin and a graft modified polyolefin.

When two waxes having a similar molecular structure are used together, a wax having a relatively lower melting point produces the plasticizing effect and a wax having a relatively higher melting point produces the mold releasing effect. At this time, when the difference between melting points is 10 to 100° C., a function separation can be effectively developed. When the difference between melting points is less than 10° C., the functional separation is difficult to be developed, and when the difference between melting points exceeds 100° C., enhancement of the function due to interaction between the two waxes is difficult to be developed. In this case, it is preferable for at least one wax to have a melting point in the range of from 70 to 120° C. and more preferably in the range of from 70 to 100° C. When the melting point is in this range, the functional separation effect tends to be easily developed.

Waxes having a branched structure, waxes having a polar group such as a functional group, and waxes modified with a component different from a main component of the waxes typically develop a plasticizing effect, and waxes having a linear structure, nonpolar waxes having no functional group, and unmodified straight waxes typically develop the mold releasing effect. Preferable combinations of waxes include combinations of a polyethylene homopolymer or copolymer including an ethylene unit as a main component and a polyolefin homopolymer or copolymer including an olefin unit other than ethylene as a main component; combinations of a polyolefin and a grafted modified polyolefin; combinations of one of an alcohol wax, a fatty acid wax and an ester wax with a hydrocarbon wax; combinations of one of a Fischer-Tropsch wax or a polyolefin wax and a paraffin wax or a microcrystalline wax; combinations of a Fischer-Tropsch wax and a polyolefin wax; combinations of a paraffin wax and a microcrystalline wax; and combinations of one of a carnauba wax, a candelilla wax, a rice wax and a montan wax with a hydrocarbon wax.

The content of the wax is preferably 0.2 to 20 parts by mass and more preferably 0.5 to 10 parts by mass with respect to 100 parts by mass of the binder resin.

The melting point of the wax is preferably 50 to 140° C., and more preferably 70 to 120° C. from the viewpoint of establishing a balance between the fixing property and the offset resistance. When the melting point is less than 50° C., there is a tendency that the blocking resistance tends to decrease, and when exceeding 140° C., the offset resistance becomes difficult to be developed. It should be noted that, in the present specification, the melting point of the wax is a temperature of a peak top of the maximum peak of an endothermic peak of the wax to be measured in differential thermal analysis (hereinafter, abbreviated as "DSC").

In the DSC measurement of the wax or toner in the present invention, it is preferable to use a high-precision inner-heat type input compensation differential scanning colorimeter. A measurement method is preferably performed according the measurement method defined in ASTM D3418-82. When a DSC curve of a substance (wax or toner) is obtained, the substance is initially subjected to a heating treatment, followed by a cooling treatment to delete the history of the substance, and is then subjected to a heating treatment at temperature increase rate of 10° C./min to obtain the DSC curve of the substance.

(Fluidizer)

The toner of the invention may further contain a fluidizer. The fluidizer improves the fluidity of the toner (makes the toner easy to flow) when it is added to a surface of the toner. Examples of the fluidizer include carbon black, particulate fluororesins such as particulate vinylidene fluoride and particulate polytetrafluoroethylene, particulate silica such as silica prepared by a wet process and silica prepared by a dry method, particulate titanium oxide, particulate alumina, or processed silica, processed titanium oxide, or processed alumina, which are obtained by processing by surface treating with a silane-coupling agent, a titanium-coupling agent, or a silicone oil. Among these substances, particulate silica, particulate titanium oxide, and particulate alumina are preferred, and the processed silica obtained by surface treating these with a silane-coupling agent or the like is more preferred.

Preferable particulate silica is a particulate body generated by a vapor phase oxidation process of a halogenated silicon compound and is called a so-called dry method silica or fumed silica. Specific examples thereof include AEROSIL-130, -300, -380, -TT600, -MOX170, -MOX80, and —COK84 from Nippon Aerosil Co.; Ca-O-SIL M-5, -MS-7, -MS-75, -HS-5, and -EH-5 from Cabot Corp.; WACKER HDK-N20, V15, -N20E, -T30, and -T40 from Wacker Chemie; D-C FINE SILICA from Dow Corning; and FRANSOL from Fransil.

Further, processed particulate silica obtained by subjecting the silica particulate generated by a vapor phase oxidation of a silicon halide compound to a hydrophobizing treatment is preferred. As the processed silica particulate, those having a hydrophobic degree of from 30 to 80%, which is obtained by measuring by a methanol titration test, are preferable. The hydrophobizing treatment is typically performed by chemically or physically treating silica with an organic silicon compound, which can react with a silica particulate or can be adsorbed on silica. A method of treating the silica particulate generated by a vapor phase oxidation of the silicon halogenated compound with an organic silicon compound is preferable.

Examples of the organic silicon compound include hydroxypropyltrimethoxysilane, phenyltrimethoxysilane, n-hexadecyltrimethoxysilane, n-octadecyltrimethoxysilane, vinylmethoxysilane, vinyltriethoxysilane, vinyltriacetoxysilane, dimethylvinylchlorosilane, divinylchlorosilane, gamma-methacryloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, alpha-chloroethyltrichlorosilane, beta-chloroethyltrichlorosilane, chloromethyldimethylchlorosilane, triorganosilylmercaptan, trimethylsilylmercaptan, triorganosilyl acrylate, vinyldimethylaetoxysilane, dimethylethoxysilane, trmethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, 1,3-diphenyltetramethyldisiloxane, and silicone oils such as dimethylpolysiloxane having 2 to 12 siloxane units per molecule and having 0 to 1 hydroxy groups binding to Si at each unit positioned at an end, and dimethylsilicone oil. These may be used alone or in a mixture of two or more kinds thereof.

The fluidizer has an average primary particle size preferably in the range of from 0.001 to 2 μm and more preferably in the range of from 0.002 to 0.2 μm. A number average particle size of the fluidizer is preferably from 5 to 100 nm and more preferably from 5 to 50 nm. Further, the fluidizer has a specific surface area due to nitrogen absorption measured by the BET method preferably 30 $m^2/g$ or more and more preferably from 60 to 400 $m^2/g$. In the case where the fluidizer is the surface-treated particulate, the specific surface area is preferably 20 $m^2/g$ or more and more preferably from 40 to 300 $m^2/g$. A content of the particulate is preferably from 0.03 to 8 parts by mass with respect to 100 parts by mass of a total of components other than the particulate.

(Other Additives)

In order to protect the photoreceptor and carrier, to improve the cleaning properties, to adjust the thermal characteristics, electric characteristics and physical characteristics, to adjust resistance, to adjust the softening point and to improve the fixing degree, the toner of the invention may further include other additives as needed. Examples of the other additive include various kinds of metal soaps, a fluorine-base surfactant, dioctyl phthalate, conductivity imparting agents such as tin oxide, zinc oxide, carbon blacks, and antimony oxide, or inorganic particulates such as titanium oxide, aluminum oxide or alumina. Further, these inorganic particulates may be hydrophobized as needed. Further, lubricants such as polytetrafluoroethylene, zinc stearate, and polyvinylidene fluoride, abrasives such as cesium oxide, silicon carbide, and strontium titanate, caking inhibitors, and developing ability improving agents such as white particulate and black particulate having a polarity opposite to that of the toner particles can also be used in a small amount.

In order to control the charge quantity of the toner, these additives are preferably treated with a treatment agent such as silicone varnishes, various kinds of modified silicone varnishes, silicone oils, various kinds of modified silicone oils, silane coupling agents, and other organic silicon compounds.

(Production Method of Toner)

The toner of the invention can be produced according to known methods as described above. The production methods of the toner can be roughly divided into a pulverization method and a polymerization method.

The production method of the toner due to the pulverization method (internal addition method) includes, for example, a step of mixing toner constituent materials including a charge control agent of the invention, a binder resin and a colorant (mixing step), a step of heating and kneading the obtained mixture (kneading step), a step of cooling and solidifying the heated and kneaded mixture (solidifying step), a step of pulverizing the cooled and solidified mixture (pulverizing step) and a step of classifying the obtained pulverized material to obtain a toner (classifying step).

In the mixing step, the binder resin, the charge control agent, and the colorant, and, as needed, the above-described toner constituent materials (additives and the like) are homogeneously mixed. In the mixing step, for example, known mixers or stirrers such as HENSCHEL MIXER, SUPER MIXER and a ball mill can be used.

In the kneading step, the obtained mixture is heated and kneaded. The kneading step can be carried out by heating/kneading using a device such as a hot roll kneader, a tightly sealed kneader, or a uniaxial or biaxial extruder.

In the solidifying step, the heated/kneaded mixture (kneaded material) is solidified by cooling. The cooling/solidifying step can be carried out, for example, by leaving the heated/kneaded mixture at room temperature, or by cooling with a cooler such as a mill roll in which cold water or brine is circulated and a clipping cooling belt.

In the pulverizing step, the cooled/solidified mixture is pulverized. The pulverizing step can be carried out by pulverizing with a pulverizer such as a jet mill or a high-speed rotor rotary mill after roughly crushing the cooled/solidified mixture by, for example, a crusher or a hammer mill.

In the classifying step, the obtained pulverized material is classified and a toner is obtained. The classifying step can be carried out by classifying to a predetermined particle size by an air classifier, inertia-classification ELBOW JET that utilizes, for example, the Coanda effect, a cyclone (centrifugal) classification MICRO PLEX, DS SEPARATOR, or the like.

The production method of the toner according to the above pulverization method (internal addition method) may include the mixing step described above, a step of atomizing by spraying after dissolving the mixture obtained in the mixing step in a solvent (atomizing step), a drying step of drying the atomized mixture (atomized substance) (drying step), and a step of obtaining a toner by classifying the dried atomized substance (classifying step).

In the atomizing step, the mixture obtained in the mixing step is dissolved in an appropriate solvent and the solution is sprayed with, for example, a sprayer to atomize the mixture.

The production method of a toner according to the pulverization method (external addition method) is performed in the same manner as the toner production method (internal addition method) due to the pulverization method except that toner constituting materials other than the charge control agent of the invention are used in the mixing step, and a toner containing the toner constituting materials other than the charge control agent of the invention is obtained. After that, a step of mixing and stirring the toner, the charge control agent of the invention and, as needed, the above-described additives (external addition step) is earned out.

In the external addition step, by thoroughly mixing and stirring by a mixer such as HENSCHEL MIXER, a ball mill, NAUTA MIXER, a v-mixer, a w-mixer or SUPER MIXER, the charge control agent of the invention is externally coated uniformly on a surface of obtained toner particles.

In the present specification, the toner obtained by the production method of the toner due to the above pulverization method is also called a "pulverization toner".

The polymerization method includes a suspension polymerization method, an emulsion aggregation method, and an emulsion polymerization method. In the polymerization method, a toner can also be produced by a method in which predetermined toner constituent materials are contained in a core material or a shell material, or in both thereof in a so-called microcapsule toner made of the core material and the shell material. Further, when a desired additive (external additive or the like) is added to a toner surface as needed, a toner can be produced by thoroughly stirring and mixing the additive and toner particles using a high-speed stirrer such as HENSCHEL MIXER or SUPER MIXER and a blender.

A production method of a toner according to the suspension polymerization method includes a step of preparing a monomer composition by uniformly dissolving or dispersing, for example, a polymerizing monomer, a colorant, a polymerization initiator, and a charge control agent, and, as needed, a crosslinking agent, a dispersion stabilizer, and other additives (preparation step), and a step of obtaining a toner by dispersing and polymerizing the monomer composition in a continuous phase (polymerization step). The continuous phase (aqueous phase, for example) may contain a dispersion stabilizer. Examples of a stirrer or a disperser used to disperse in the polymerization step include a homomixer, a homogenizer, an atomizer, a microfluidizer, a single liquid fluid nozzle, a gas-liquid fluid nozzle or an electric emulsifier. In the polymerization step, it is preferable to granulate by adjusting a stirring speed, a temperature and a time such that liquid droplets of the monomer composition may be a desired magnitude of the toner particles. A polymerization reaction may be performed at, for example, 40 to 90° C. The polymerization reaction may be performed while dispersing the monomer composition in a continuous phase. The production method of the toner according to the suspension polymerization method may further include a step of drying after cleansing and filtering toner particles obtained by the polymerization step. In the external addition process after production of the toner particles, the above-described method can be used.

A production method of a toner due to an emulsion aggregation method includes, for example, a step of preparing various dispersion solutions containing constituting materials of the toner particles such as a charge control agent dispersion solution, a binder resin dispersion solution, and a colorant dispersion solution (dispersion solution preparing step), a step of mixing the dispersion solutions to obtain a mixed solution (mixing step), a step of aggregating the mixed solution to form aggregated particles (aggregated particles forming step), and a step of heating and fusing the obtained, aggregated particles to obtain toner particles (fusing step), The production method of the toner due to the emulsion aggregation method may further include a step of cleansing the toner particles obtained in the fusing step (cleansing step), and a step of drying the cleansed toner particles (drying step). The respective dispersion solutions may be produced by using a dispersant such as a surfactant.

A production method of a toner due to the emulsion polymerization method includes, for example, a step of emulsifying and dispersing a polymerizing monomer and colorant supporting resin particles in an aqueous medium (emulsifying and dispersing step), and a step of polymerizing the polymerizing monomer (polymerizing step). The polymerizing step may further include addition of an aqueous polymerization initiator to an emulsifying and dispersing solution. The polymerizing monomer can be polymerized by, for example, heating. Toner particles obtained by the emulsion polymerization method have excellent uniformity compared with toner particles obtained by the suspension polymerization method but an average particle size becomes very small such as 0.1 to 1.0 μm. Therefore, as the case may be, the emulsified particles may be subjected to a so-called seed polymerization, in which the particles are grown by adding a polymerizable monomer with the emulsified particles used as nuclei. Alternatively, the emulsified particles may be adhered with each other or fused until an appropriate average particle size is obtained.

Since these polymerization methods do not include a pulverization step, there is no need to impart brittleness to the toner particles. Further, since the low softening point substance that was difficult to use in the conventional pulverization method can be used in a large amount, a selection width of the materials can be expanded. Further, since the mold releasing agent and the colorant that are hydrophobic materials are difficult to be exposed on a surface of the toner particles, contamination on a toner support member, a photoreceptor, a transfer roller and a fixer can be reduced.

The toner obtained by the polymerization method can further improve characteristics such as image reproducibility, transferability, and color reproducibility. Further, the toner is also suitable for obtaining high image quality because a toner having a small particle size and a sharp particle size distribution can be relatively easily obtained.

The polymerizing monomer that is used when the present toner is produced by the polymerization method is selected such that a desired binder resin may be obtained by polymerization. As the polymerizing monomer, for example, a monofunctional or polyfunctional vinyl polymerizing monomer that can be radically polymerized can be used.

Examples of the monofunctional polymerizing monomer include styrene polymerizing monomers such as styrene, alfa-methylstyrene, beta-methylstyrene, o-methylstyrene, m-methylstyrene, p-methylstyrene, 2,4-dimethylstyrene, p-n-butylstyrene, p-tert-butylstyrene, p-n-hexylstyrene, and p-phenylstyrene; acrylate polymerizing monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, benzyl acrylate, dimethylphosphate methyl acrylate, dibutylphosphate ethyl acrylate, and 2-benzoyl oxy ethyl acrylate; methacrylate polymerizing monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, diethylphosphate methacrylate, and dibutylphosphate ethyl methacrylate; unsaturated aliphatic monocarboxylic acid esters; vinyl esters such as vinyl acetate, vinyl propionate, and vinyl benzoate; vinyl ethers such as vinyl methyl ether and vinyl isobutyl ether;

and vinyl ketones such as vinyl methyl ketone, vinyl hexyl ketone, and vinyl isopropyl ketone.

As a polymerization initiator that is used to produce the toner of the invention by the polymerization method, known initiators such as organic peroxides can be used. Examples of an aqueous initiator include ammonium persulfate, potassium persulfate, 2,2'-azobis(N,N'-di methyleneisobutyloamidin)hydrochloride 2,2'-azobis(2-aminodipropane)hydrochloride, azobis(isobutylamidin)hydrochloride, 2,2'-azobisisobutylonitrile sodium sulfonate, ferrous sulfate, or hydrogen peroxide. These may be used alone or in a combination of two or more kinds thereof. The polymerization initiator is preferably added in an amount of from 0.5 to 20 parts by mass with respect to 100 parts by mass of the polymerizing monomer.

Examples of a dispersing agent preferably used during the production of the polymerization toner include inorganic oxides such as calcium triphosphate, magnesium phosphate, aluminum phosphate, zinc phosphate, calcium carbonate, magnesium carbonate, aluminum hydroxide, calcium metasilicate, calcium sulfate, barium sulfate, bentonite, silica and alumina. Examples of an organic compound include polyvinyl alcohol, gelatin, methyl cellulose, methylhydroxypropyl cellulose, ethyl cellulose, sodium salt of caroboxymethyl cellulose and starch.

As the dispersing agent, commercially available dispersing agents may be used as they are. However, in order to obtain dispersion particles having a uniform fine particle size, these inorganic compounds may be generated in a dispersion medium under high-speed stirring. The dispersing agent is preferably used in an amount of from 0.2 to 2.0 parts by mass with respect to 100 parts by mass of polymerizing monomer.

Since the toner obtained by the polymerization method tends to have a degree of roughness of the toner particles smaller than that of the toner obtained by the pulverization method and has an irregular contour, a contact area between an electrostatic latent image carrier and the toner increases and an adhesive force of the toner becomes higher. As a consequence, contamination of the interior of the machine is more effectively avoided, and acquisition of higher density and higher quality images is more readily achieved.

Further, also in the toner produced by the pulverization method, the degree of roughness of the toner surfaces may be reduced by a water bath method in which toner particles are dispersed in water and heated, by a thermal treatment method in which toner particles are allowed to pass through a hot air jet, or by a mechanical impact method in which mechanical energy is applied to toner particles. Apparatuses suitably used for reducing the surface roughness of toner particles may include MECHANO FUSION SYSTEM (Hosokawa-Micro) based on dry mechano-chemical treatment, an I type jet mill, a hybridizer (Nara Manufacturing Co.) that is a mixer including a rotor and a liner, and HENSCHEL MIXER that is a mixer including a high speed agitation blade.

As one of the values that shows the degree of roughness of toner particles, there is the average degree of circularity. The average degree of circularity (C) is a value obtained by dividing a sum total of the degrees of circularity (Ci) of all measured particles by a total number of measured particles (m) and can be obtained by the following formulae (2) and (3).

[Mathematical formula 1]

$$\text{Degree of circularity } (Ci) = \frac{\text{Boundary length of circle having the same projected area as that of particle}}{\text{Boundary length of projection image of particle}} \quad (2)$$

-continued

[Mathematical formula 2]

$$\text{Average degree of circularity } C = \sum_{i=1}^{m} Ci/m \quad (3)$$

The degree of circularity (Ci) is determined using a flow particle image analysis system (for example, FPIA-1000 provided by boa Medical Electronics). A determination method of the degree of circularity may include dispersing about 5 mg of toner in 10 ml of water to which about 0.1 mg of a nonionic surfactant has been dissolved to produce a suspension, exposing the suspension to an ultrasonic wave (20 kHz, 50 W) for 5 minutes, adjusting the concentration of the suspension such that it contains 5000 to 20000 particles/μl, and subjecting the suspension to the measurement with the flow particle analysis system to obtain the distribution curve of particles having a circle-equivalent diameter in the range of 0.60 μm or higher to less than 159.21 μm.

Toner particles are preferably adjusted such that their average degree of circularity falls in the range of from 0.955 to 0.995, more preferably from 0.960 to 0.985. When the toner particles are adjusted such that their degree of circularity falls in this range, there is a tendency that it is difficult to induce an increase in the toner left without being transferred and to cause renewed retransfer.

In the present specification, the toner obtained by the production method of the toner by the above polymerization method is also called a "polymerization toner". Further, in particular, the toner obtained by the suspension polymerization method is called a "suspension polymerization toner", the toner obtained by the emulsion aggregation method is called an "emulsion aggregation toner" and the toner obtained by the emulsion polymerization method is called an "emulsion polymerization toner".

(Toner)

The toner of the invention is thermally stable, does not undergo thermal change during an electrophotographic process, and may stably maintain charging characteristics. Further, a charge distribution of a fresh toner is uniform because the toner is uniformly dispersed in any binder resin. Therefore, even when the toner of the invention is a toner that is not transferred or a toner that is recovered (waste toner), both hardly exhibit a change in a saturated triboelectrostatic charge amount and a charge distribution compared with the fresh toner. However, in the case where the waste toner generated from the toner of the invention is reused, when a toner is produced using a polyester resin containing aliphatic dial or a styrene-acrylate copolymer crosslinked with metal as the binder resin together with a large amount of polyolefin, the difference to the fresh toner can be made even smaller.

A volume average particle size of the toner of the invention is defined as an average particle size (volume basis) in a measurement that uses a laser type particle size distribution meter such as a micron sizer (for example, one provided by Seishin Co.). In the case of the pulverization toner, the toner of the invention preferably has a volume average particle size in the range of from 2 to 15 μm in view of faithful reproduction of images and improved cost-effective production. When the toner has a volume average particle size of 15 μm or less, the resolution and sharpness of images may be clearer. On the contrary, when the toner particles have an average particle size of 2 μm or more, in addition to that the resolution in an image may be further improved, the yield during production of the toner is further improved and the cost is further reduced, and the toner spreading in the internal space of the machine, and adverse effects on health such as skin penetration, may be more reduced. From a viewpoint of further bringing out these effects, the volume average particle size of the pulverization toner is preferably 2 to 12 μm, more preferably 2 to 9.5 μm, still more preferably 3 to 12 μm and particularly preferably 3 to 9.5 μm.

On the other hand, in the case of the polymerization toner, a volume average particle size of the polymerization toner is preferably 2 to 9.5 μm. When the volume average particle size is 2 μm or more, the fluidity of the toner is further improved, degradation of the charging property of each particle and spreading of the charge distribution become more difficult to occur, fog on the background or fall out of the toner from a developing system becomes more difficult to occur and the cleaning amenability becomes more excellent. When the volume average particle size is 9.5 μm or less, the resolution is further suppressed from degrading, and image quality sufficiently satisfying recent requirements for high image quality becomes easy to obtain. From the viewpoint of further bringing out these effects, the volume average particle size of the polymerization toner is more preferably 3 to 9 μm, still more preferably 4 to 8.5 μm, and particularly preferably 5 to 8 μm.

Further, the polymerization toner of the invention has a volume average particle size distribution index (GSDv) preferably in the range of from 1.15 to 1.30 and more preferably in the range of from 1.15 to 125. The volume average particle size distribution index is a value calculated from (D84%/16%)½ when each cumulative distributions of volume and number is depicted from a small particle side for divided particle size ranges (channels) from a particle size distribution measured by the following method, and a particle size where a cumulative value becomes 16%, a particle size where a cumulative value becomes 50%, and a particle size where a cumulative value becomes 84% are defined as volume D16%, volume D50% and volume D84%, respectively.

In the present invention, the particle size distribution of the toner is measured by using, for example, COULTER COUNTER (TA-II manufactured by Beckman Coulter, Inc.).

The particle size distribution of the toner of the invention measured by the above method is desirably such that the content of particles of 2 μm or less is 10 to 90% on the particle number basis and the content of particles of 12.7 μm or more is 0 to 30% on the volume basis. Further, those having higher particle size uniformity (volume average particle size/number average particle size is 1.00 to 1.30) are preferred.

The BET specific surface area of the toner of the invention using desorption and adsorption gas as nitrogen is preferably from 1.2 to 5.0 $m^2/g$ and more preferably from 1.5 to 3.0 $m^2/g$. The BET specific surface area is measured by using, for example, a BET specific surface area measuring apparatus (for example, FlowSorb II 2300 manufactured by Shimadzu Corporation). Namely, the gas adsorbed by the surfaces of the toner is removed at 50° C. for 30 minutes, quenched with liquid nitrogen and the nitrogen gas is adsorbed again. The temperature is elevated again to 50° C., and the value found from the amount of the gas that is removed at this moment is used to find the BET specific surface area.

The apparent specific gravity (bulk density) of the toner of the invention is preferably 0.2 to 0.6 $g/cm^3$ in the case of a nonmagnetic toner, and is preferably 0.2 to 2.0 $g/cm^3$ in the case of a magnetic toner, though it may be different depending on the kind and content of the magnetic substance. The apparent specific gravity in this case is defined to be a value measured by using, for example, a powder tester (manufactured by HOSOKAWA MICRON CORPORATION).

When the toner of the invention is the non-magnetic toner, the true specific gravity of the toner is preferably from 0.9 to 1.2 $g/cm^3$ and when the toner of the invention is the magnetic toner, the true specific gravity of the toner is preferably from 0.9 to 4.0 $g/cm^3$ though it may vary depending upon the kind and content of the magnetic powder. The true specific gravity of the toner in this case is calculated in the manner described below. Namely, 1.000 g of the toner is accurately weighed and is introduced into a 10 mmϕ tablet-forming mold, and is compression-formed in vacuum under a pressure of 200 $kgf/cm^2$. The thus formed cylindrical article is subjected to measurement of its height by using a micrometer. The true specific gravity is calculated from the measured value.

A dynamic angle of repose of the toner of the invention is preferably from 5 to 45 degrees and a static angle of repose is preferably from 10 to 50 degrees. The dynamic angle of repose and the static angle of repose of this time are defined as the dynamic angle of repose and the static angle of repose as measured by using an angle of repose-measuring apparatus (manufactured by, for example, TSUTSUI SCIENTIFIC INSTRUMENTS CO., LTD). The dynamic angle of repose and the static angle of repose relate to the fluidity of the toner.

When the toner of the invention is the toner produced by the pulverization method, it is preferred that an average value of the shape factor (SF-1) of the toner is preferably 100 to 400 and the average value of the shape factor (SF-2) is preferably 100 to 350.

The shape factors SF-1 and SF-2 of the toner in the specification can be obtained as described below. By using, for example, an optical microscope (for example, BH-2 manufactured by OLYMPUS CORPORATION) equipped with a CCD camera, a group of toner particles magnified by 1000 times is sampled such that the number of toner particles may be about 30 in one viewing field, an obtained image is transferred to an image analyzer (for example, LUZEX FS manufactured by Nireco Corporation), and this operation is repeated until the number of the toner particles may be about 1000. The shape factor (SF-1) and the shape factor (SF-2) are calculated from the following formulae.

$$SF\text{-}1\{(ML^2\times\pi)/4A\}\times 100$$

(wherein, ML is a maximum length of the particle, and A is a projected area of one particle.)

$$SF\text{-}2=(PM^2/4A\pi)\times 100$$

(wherein, PM is a circumferential length of the particle, and A is a projected area of one particle.)

The value SF-1 represents distortion of the particles. If the particles are close to spheres, the value SF-1 approaches 100. If slender, the value SF-1 increases further. The value SF-2 represents roughness of the particles. If the particles are close to spheres, the value SF-2 approaches 100. If the particles have complex shapes, the value SF-2 increases further.

When the toner of the invention is the non-magnetic toner, the volume resistivity of the toner is preferably from $1\times10^{12}$ to $1\times10^{16}$ Ω·cm. When the toner is the magnetic toner, the volume resistivity of the toner is preferably from $1\times10^{8}$ to $1\times10^{16}$ Ω·cm though it may vary depending on the kind and content of the magnetic powder. The volume resistivity of the toner in this case is calculated as described below. That is, the toner particles are compression-formed to prepare a disk-like test piece 50 mm in diameter and 2 mm in thickness. The test piece is set onto electrodes for a solid material (for example, SE-70 manufactured by Ando Electric Co., Ltd.), and a DC voltage of 100 V is continuously applied thereto by using an insulation resistance tester (for example, 4339A manufactured by Hewlett-Packard Company). The resistivity after the continuous application of voltage for one hour is defined to be the volume resistivity When the toner of the invention is the non-magnetic toner, the dielectric loss tangent of the toner is preferably from $1.0\times10^{-3}$ to $15.0\times10^{-3}$. When the toner is the magnetic toner, the dielectric loss tangent is preferably from $2\times10^{-3}$ to $30\times10^{-3}$ though it may vary depending on the kind and content of the magnetic powder. The dielectric loss tangent of the toner in this case is defined as a dielectric loss tangent value (Tan δ) obtained when the toner particles are compression-formed to prepare a disk-like test piece 50 mm in diameter and 2 mm in thickness. This test piece is then set onto the electrodes for the solid material, and is measured under the conditions of a measuring frequency of 1 KHz and a peak-to-peak voltage of 0.1 KV by using an LCR meter (for example, 4284A manufactured by Hewlett-Packard Company).

The toner of the invention has an Izod impact value of, preferably, from 0.1 to 30 kg·cm/cm. The Izod impact value of the toner in this case is measured as described below. That is, the toner particles are heat-melted to prepare a plate-like test piece. The test piece is subjected to measurement of its Izod impact value in accordance with JIS K-7110 (Impact Testing Method of Hard Plastics).

The toner of the invention has a melt index (MI value) of, preferably, from 10 to 150 g/10 min. The melt index (MI value) of the toner is measured in accordance with JIS K-7210 (Method A). In this case, a measuring temperature is set to 125° C. and a weight is set to 10 kg.

The toner of the invention has a melt start temperature of preferably, from 80 to 180° C. and a 4 mm fall-down temperature of, preferably, from 90 to 220° C. The melt start temperature of the toner in this case is measured as described below. That is, the toner particles are compression-formed to prepare a cylindrical test piece 10 mm in diameter and 20 mm in thickness. The test piece is set onto a heat melt property-measuring apparatus such as flow tester (for example, CFT-500C manufactured by Shimadzu Corporation), and is subjected to measurement of its temperature at a moment when a piston starts falling under a condition of a load of 20 kgf/cm$^2$. This temperature is defined as a melt start temperature based on an idea that the piston starts falling when the toner starts melting. Based on the same measuring method, the temperature is measured at a moment when the piston falls down by 4 mm. This temperature is defined as the 4 mm fall-down temperature.

The toner of the invention has a glass transition temperature (Tg) of, preferably, from 35 to 80° C. and, more preferably, from 40 to 75° C. The glass transition temperature of the toner in this case is measured by using a differential scanning calorimeter (DSC) as described below. That is, the glass transition temperature (Tg) is found from a peak value in a change of phase that appears when the toner is heated at a constant heating rate, quenched and is heated again. If the Tg of the toner is lower than 35° C., the offset resistance and storage stability tend to decrease. If the Tg of the toner exceeds 80° C., the fixing strength of a picture tends to decrease. The toner of the invention has a peak top temperature of a maximum peak in a region of, preferably, from 70 to 120° C. in an endothermic peak observed in the DSC measurement.

The toner of the invention has a melt viscosity of, preferably, from 1,000 to 50,000 poises and, more preferably, from 1,500 to 38,000 poises. The melt viscosity of the toner in this case is measured as described below. That is, the toner particles are compression-formed to prepare a cylindrical test piece 10 mm in diameter and 20 mm in thickness. The test piece is set onto a heat-melt property measuring apparatus, for example, a flow tester (CFT-500C manufactured by Shimadzu Corporation) and its melt viscosity is measured under a condition of a load of 20 kgf/cm$^2$. This viscosity is defined as the melt viscosity of the toner.

It is preferable that the components of the toner of the invention that remain without being dissolved in the solvents include 0 to 30 mass % of the component that does not dissolve in THF, 0 to 40 mass % of the component that does not dissolve in ethyl acetate, and 0 to 30 mass % of the component that does not dissolve in chloroform. The components that remain without being dissolved in the solvents in this case are measured as described below. That is, one gram of the toner is homogeneously dissolved or dispersed in 100 ml of each of the THF, ethyl acetate and chloroform. The solutions or the dispersion solutions are filtered with pressure. The filtrates are dried and determined, from which the ratios of the components of the toner that did not dissolve in the organic solvents are calculated.

The toner of the invention is used for electrophotography and is preferably used for electrostatic charge development.

(Developer)

The toner of the invention may be used for a single-component developing system and a two-component developing system. The single-component developing system is a system that develops a latent image by feeding toner in the form of a thin film onto a latent image carrier. The toner is formed into a thin film, usually, by using an apparatus that includes a toner conveyer member, a toner layer thickness limiting member and a toner feed assist member, the feed assist member and the toner conveyer member being in contact with each other, and the toner layer thickness limiting member and the toner conveyer member being in contact with each other.

Further, the two-component developing system is a method that uses a toner and a carrier. As the carrier, for example, the magnetic substance described above and glass beads may be used. The two-component developing system is carried out as described below. The developer (toner and carrier) is stirred by a stirrer member to generate a predetermined amount of electric charge, and is conveyed by a magnet roller or the like to a developing portion. The developer is held on the surface of the magnet roller due to the magnetic force, and a magnetic brush is formed in the form of a layer being limited to a suitable height by a developer limiting plate or the like. Accompanying the rotation of the developing roller, the developer moves on the roller and is brought into contact with the electrostatic latent image-holding member or is opposed thereto in a non-contacting manner maintaining a predetermined gap to develop and visualize the latent image. When developing in a non-contacting manner, a DC electric field may be established between the developer and the latent image-holding member to produce a driving force for flying the toner in the space of a predetermined gap. To obtain a more vivid image, however, the invention may be applied to a system in which an alternating current is superposed.

The toner of the invention may be used as a developer (may be called as "two-components developer" in the present specification) by mixing with a carrier. As the carrier, carriers (non-coat carrier) such as ordinary ferrite and magnetite and resin-coated carriers may be used. Further, also a binder-type carrier core in which magnetic substance is dispersed in a resin may be used.

As the carrier, oxides such as ferrite, excess iron-type ferrite, magnetite and γ-iron oxide, metals such as iron, cobalt or nickel, or alloys thereof may be used. As the elements contained in the magnetic substances, there may be exemplified iron, cobalt, nickel, aluminum, copper, lead, magnesium, tin, zinc, antimony, beryllium, bismuth, calcium, manganese, selenium, titanium, tungsten and vanadium. Preferably, there may be used copper-zinc-iron ferrite containing mainly copper, zinc and iron component, and manganese-magnesium-iron ferrite containing mainly manganese, magnesium and iron component.

The resin-coated carrier includes carrier core particles and a coating material. The coating material, is a resin for covering the surfaces of the carrier core particles. The carrier core particles may be, for example, the above carrier. As the resin for the coating material, styrene-acrylate resins such as a styrene-acrylic ester copolymer and a styrene-methacrylic ester copolymer; acrylate resins such as an acrylic ester copolymer and a methacrylic ester copolymer; fluorine-containing resins such as polytetrafluoroethylene, a monochlorotrifluoroethylene polymer and vinylidene polyfluoride; a silicone resin; a polyester resin; a polyamide resin; polyvinyl butyral; and an aminoacrylate resin may be preferably used. Other than the above resins, any resins that work to cover the carrier, such as ionomer resin and a polyphenylene sulfide resin may be used. Among these resins, a styrene-methyl methacrylate copolymer, a mixture of fluorine-containing resin and styrene copolymer, or a silicone resin are preferable, and a silicone resin is particularly preferable. These resins may be used in one kind alone or in a combination of two or more kinds thereof.

As the mixture of the fluorine-containing resin and a styrene copolymer, for example, a mixture of vinylidene polyfluoride and a styrene-methyl methacrylate copolymer; a mixture of polytetrafluoroethylene and a styrene-methyl methacrylate copolymer; and a mixture of a vinylidene fluoride-tetrafluoroethylene copolymer (copolymer mass ratio of 10:90 to 90:10), a styrene-acrylic acid-2-ethylhexyl copolymer (copolymer mass ratio of 10:90 to 90:10) and a styrene-acrylic acid-2-ethylhexyl-methyl methacrylate copolymer (copolymer mass ratio of 20:60:5 to 30:10:50) may be used.

As the silicone resin, a nitrogen-containing silicone resin and a modified silicone resin formed by the reaction of a nitrogen-containing silane coupling agent with a silicone resin may be used.

As a method of coating the surfaces of the carrier cores with a coating material in the resin-coated carrier, a method of dissolving or suspending the resin in a solvent so as to apply or adhere the resin onto the carrier cores, or a method of mixing the carrier core particles and the coating resin in the form of powders together may be used. A ratio of the resin coating material to a total of the resin-coated carrier may be appropriately determined, but is, preferably, from 0.01 to 5 mass % and, more preferably, from 0.1 to 1 mass %.

The resin-coated carrier may be coated with the coating agent of a mixture of two or more kinds. Examples of coating the carrier core (magnetic body) with a mixture of resins of two or more kinds include (1) a case of treating 100 parts by mass of the fine titanium oxide powder with 12 parts by mass of a mixture of dimethyldichlorosilane and dimethylsilicon oil (mass ratio of 1:5), and (2) a case of treating 100 parts by mass of the fine silica powder with 20 parts by mass of a mixture of dimethyldichlorosilane and dimethylsilicon oil (mass ratio of 1:5).

The resistance of the carrier is preferably set to $10^6$ to $10^{10}$ Ω·cm by adjusting the surface roughness of the carrier and an amount of coated resin. The particle size of the carrier may be 4 to 200 μm, preferably 10 to 150 μm and more preferably 20 to 100 μm. In the case of the resin-coated carrier in particular, the 50% particle size is preferably 20 to 70 μm.

In the two-component developer, the toner of the invention is preferably used in the range of from 1 to 200 parts by mass and more preferably used in the range of from 2 to 50 parts by mass with respect to 100 parts by mass of the carrier.

When the toner is the pulverization toner or the emulsion aggregation toner in the two-component developer of the invention, the carrier is preferable to be the resin-coated carrier. A developer having very excellent environmental stability of an amount of electric charge may be provided. In order for the resin-coated carrier in this case to more bring out the above effects, the carrier containing ferrite is more preferably a silicone-coated ferrite carrier coated with a coating material containing a silicone resin. The toner in this case is preferable to contain one or two or more charge control agents selected from the above compound 5, the compound 12, the compound 13 or the compound 21 from the viewpoint of further bringing out the above effects.

When the toner is the suspension polymerization toner in the two-component developer of the invention, the carrier is preferable to be a non-coat carrier. Thus, a developer that has a high amount of electric charges and excellent environmental stability of the amount of electric charges may be provided. The non-coat carrier in this case is more preferably a carrier containing ferrite from the viewpoint of further bringing out the above effects. The toner in this case preferably contains one or two or more kinds of the charge control agents selected from the compound 13, the compound 17 or the compound 21 from the viewpoint of further bringing out the above effects.

EXAMPLES

The invention will now be described in more detail by way of Examples which, however, are in no way to limit the invention. In Examples, "parts" all represent "parts by mass".

The resorcin derivative represented by the formula (1) were purified by column chromatography, adsorption by means of silica gel, active carbon or activated soil, recrystallization using a solvent, or crystallization or the like. Further, compounds were identified by an NMR analysis.

(Synthesis Example 1)

(Synthesis of Compound 2)

In a reactor purged with nitrogen, 100 ml of ethanol, 11.0 g (100 mmol) of resorcin, and 11.6 g (100 mmol) of benzaldehyde were added, and, while keeping a reaction temperature at 10 to 15° C., 10 ml of 35% hydrochloric acid was dropped. After further heating, a reaction solution was stirred at 70° C. for 18 hours. After leaving to cool, the reaction solution was added to water, and a precipitated crude product was sampled by filtering. After the crude product was purified by recrystallizing with ethanol, by drying at 60° C. under reduced pressure, 19.2 g (yield: 96.7%) of grayish white crystal was obtained.

The structure of the obtained grayish white crystal was identified by the NMR measurement.

The following 40 hydrogen signals were detected by $^1$H-NMR (DMSO-$d_6$). δ (ppm)=5.63 (8H), 6.13 (4H), 6.74 (8H), 6.96 (12H), 8.58 (8H).

(Synthesis Example 2)

(Synthesis of Compound 5)

In a reactor purged with nitrogen, 100 ml of ethanol, 14.6 g (130 mmol) of resorcin, and 20.8 g (130 mmol) of n-decanol were added, and, while keeping a reaction temperature at 10 to 15° C., 13 ml of 35% hydrochloric acid was dropped. After further heating, a reaction solution was stirred at 70° C. for 15 hours. After leaving to cool, the reaction solution was added to water, and a precipitated crude product was sampled by filtering. After the crude product was purified by recrystallizing with ethanol, by drying at 60° C. under reduced pressure, 19A g (yield: 60.1%) of yellowish white crystal was obtained.

The structure of the obtained yellowish white crystal was identified by the NMR measurement.

The following 96 hydrogen signals were detected by $^1$H-NMR (DMSO-$d_6$). δ (ppm)=0.84 (12H), 1.21 to 1.26 (56H), 1.96 (8H), 4.22 (4H), 6.14 (4H), 7.07 (4H), 8.86 (8H).

(Synthesis Example 3)

(Synthesis of Compound 12)

In a reactor purged with nitrogen, 100 ml of ethanol, 12.4 g (100 mmol) of 2-methylresorcinol, and 12.8 g (100 mmol) of n-octanol were added, and, while keeping a reaction temperature at 10 to 15° C., 10 ml of 35% hydrochloric acid was dropped. After further heating, a reaction solution was stirred at 75° C. for 10 hours. After leaving to cool, the reaction solution was added to water, and a precipitated crude product was sampled by filtering. After the crude product was cleaned with methanol, by drying at 60° C. under reduced pressure, 19.3 g (yield: 82.5%) of faint yellow crystal was obtained.

The structure of the obtained faint yellow crystal was identified by the NMR measurement.

The following 80 hydrogen signals were detected by $^1$H-NMR (DMSO-$d_6$). δ (ppm)=0.85 (12H), 1.15 to 1.34 (40H), 1.93 (12H), 2.19 (8H), 4.19 (4H), 7.20 (4H), 8.65 (8H).

(Synthesis Example 4)

(Synthesis of Compound 13)

In a reactor purged with nitrogen, 100 ml of ethanol, 12.4 g (100 mmol) of 2-methylresorcinol, and 15.6 g (100 mmol) of n-decanol were added, and, while keeping a reaction temperature at 10 to 15° C., 10 ml of 35% hydrochloric acid was dropped. By further heating, a reaction solution was stirred at 70° C. for 15 hours. After leaving to cool, the reaction solution was added to water, and a precipitated crude product was sampled by filtering. After the crude product was purified by recrystallizing with ethanol, by drying at 60° C. under reduced pressure, 21.9 g (yield: 83.6%) of yellowish white crystal was obtained.

The structure of the obtained yellowish white crystal was identified by the NMR measurement.

The following 104 hydrogen signals were detected by $^1$H-NMR (DMSO-$d_6$). δ (ppm)=0.86 (12H), 1.23 (62H), 1.94 (8H), 2.16 (6H), 4.18 (4H), 7.16 (4H), 8.67 (8H).

(Synthesis Example 5)

(Synthesis of Compound 14)

In a reactor purged with nitrogen, 100 ml of ethanol, 12.6 g (100 mmol) of pyrogallol, and 11.4 g (100 mmol) of n-heptanol were added, and, while keeping a reaction temperature at 10 to 15° C., 10 ml of 35% hydrochloric acid was dropped. After further heating, a reaction solution was stirred at 70° C. for 15 hours. After leaving to cool, the reaction solution was added to water, and a precipitated crude product was sampled by filtering. After the crude product was purified by recrystallizing with ethanol, by drying at 60° C. under reduced pressure, 14.8 g (yield: 66.6%) of grayish white crystal was obtained.

The structure of the obtained grayish white crystal was identified by the NMR measurement.

The following 72 hydrogen signals were detected by H-NMR (DMSO-$d_6$). δ (ppm)=0.85 (12H), 1.14 to 1.35 (32H), 2.12 to 2.13 (8H), 4.14 (4H), 6.84 (4H), 8.13 (4H), 8.64 (8H).

(Synthesis Example 6)

(Synthesis of Compound 17)

In a reactor purged with nitrogen, 100 ml of ethanol, 15.6 g (100 mmol) of 2, 6-dihydroxyacetophenone, and 11.4 g (100 mmol) of benzaldehyde were added, and, while keeping a reaction temperature at 10 to 15° C., 28 ml of 35% hydrochloric acid was dropped. After further heating, a reaction solution was stirred at 75° C. for 10 hours. After leaving to cool, the reaction solution was added to water, and a precipitated crude product was sampled by filtering. After the crude product was purified by recrystallizing with ethanol, by drying at 60° C. under reduced pressure, 14.8 g (yield: 66.6%) of grayish white crystal was obtained.

The structure of the obtained grayish white crystal was identified by the NMR measurement.

The following 48 hydrogen signals were detected by $^1$H-NMR (DMSO-$d_6$). δ (ppm)=2.49 (12H), 3.25 (8H), 5.56 to 5.57 (4H), 6.38 to 6.39 (10H), 6.76 to 6.82 (10H), 10.70 (2H), 11.01 (2H).

(Synthesis Example 7)

(Synthesis of Compound 21)

In a reactor purged with nitrogen, 200 ml of dimethylsulfoxide, 3.0 g (6.3 mmol) of the resorcin derivative synthesized in Synthesis Example 3 (compound 12), and 5.0 g (25.2 mmol) of 2,3-dichloroquinoxaline were added, and, while keeping a reaction temperature at 30° C. or less, 8.6 g (26.5 mmol) of cesium carbonate was added. After the end of addition, by stirring at 30° C. for 72 hours, a precipitated crystal was sampled by filtering. After the crystal was dispersed and washed with ethyl acetate, by filtering and drying, 7.3 g (yield: 80.0%) of yellow crystal was obtained.

The structure of the obtained faint yellow crystal was identified by the NMR measurement.

The following 96 hydrogen signals were detected by $^1$H-NMR ($CDCl_3$). δ (ppm)=0.7 (12H), 1.05 to 1.07 (40H), 1.78 to 1.90 (8H), 2.25 (6H), 3.16 (6H), 3.53 to 3.54 (4H), 6.18 (2H), 6.87 (2H), 7.16 (4H), 7.43 (4H), 7.65 (4H), 7.79 (4H).

(Example 8)

(Production and Evaluation of Non-magnetic Toner 1)

Firstly, 91 parts by mass of a styrene-acrylate copolymer resin (manufactured by Mitsui Chemicals, Inc., Product Name: CPR-100, acid value: 0.1 mg KOH/g), one part by mass of the resorcin derivative synthesized in Synthesis Example 2 (compound 5), 5 parts by mass of carbon black (manufactured by Mitsubishi Chemical Corporation, Product Name: MA-100) and 3 parts by mass of low molecular weight polypropylene (manufactured by Sanyo Chemical Industries, Ltd., Product Name: BISCOHL 550P) were melt-mixed by a heating and mixing device (biaxial extrusion kneader) set at 130° C. After roughly crushing the cooled mixture by a hammer mill, followed by pulverizing by a jet mill, further followed by classifying, a non-magnetic toner 1 having a volume average particle size of 8±0.5 μm was obtained.

Firstly, the obtained nonmagnetic toner 1 was mixed with a non-coat ferrite carrier (manufactured by Powdertech, product name: F-150) at a ratio of 4 parts by mass to 100 parts by mass and shaken to negatively charge the toner. Then the saturated charge amount of the toner was measured each under an atmosphere of temperature of 10° C. and humidity of 30% (under LL environment) and under an atmosphere of temperature of 35° C. and humidity of 85% (under HH environment) using a blow-off powder electric charge-measuring meter. The results are collectively shown in Table 1. In the Table, LL/HH is a ratio of "saturated charge amount under low temperature and low humidity (under LL environment)" to "saturated charge amount under high temperature and high humidity (under HH environment)" and is a value to be an index of the environmental stability.

In the same manner also in the case of mixing with silicon-coated ferrite carrier (trade name: F96-150, manufactured by Powdertech), the saturated charge amount and environmental stability were evaluated. Results are shown in Table 1.

TABLE 1

| | Charge control agent | Carrier F-150 Saturated charge amount (μC/g) LL | HH | Environmental stability LL/HH | Carrier F96-150 Saturated charge amount (μC/g) LL | HH | Environmental stability LL/HH |
|---|---|---|---|---|---|---|---|
| Example 8 | Compound 5 | −41.8 | −31.0 | 1.35 | −22.7 | −18.8 | 1.21 |
| Example 9 | Compound 13 | −42.3 | −34.6 | 1.22 | −22.2 | −19.0 | 1.17 |
| Example 10 | Compound 21 | −35.0 | −16.5 | 2.12 | −26.1 | −12.8 | 2.04 |
| Comparative Example 1 | Comparative compound 1 | −39.5 | −15.8 | 2.50 | −22.9 | −7.60 | 3.01 |

(Example 9)

(Production and Evaluation of Non-Magnetic Toner 2)

Non-magnetic toner 2 was produced under the same condition as that of Example 8 except that the compound 5 used as the charge control agent in Example 8 was replaced with the resorcin derivative (compound 13) synthesized in Synthesis Example 4, and the saturated charge amount and the environmental stability were evaluated. Results are shown in Table 1.

(Example 10)

(Production and Evaluation of Non-Magnetic Toner 3)

Non-magnetic toner 3 was produced under the same condition as that of Example 8 except that the compound 5 used as the charge control agent in Example 8 was replaced with the resorcin derivative (compound 21) synthesized in Synthesis Example 7, and the saturated charge amount and the environmental stability were evaluated. Results are shown together in Table 1.

(Comparative Example 1)

(Production and Evaluation of Comparative Non-Magnetic Toner)

A comparative non-magnetic toner was produced under the same condition as that of Example 8 except that the compound 5 used as the charge control agent in Example 8 was replaced with the following comparative compound 1, and the saturated charge amount and the environmental stability were evaluated. Results are shown together in Table 1.

[Chemical Formula 33]

(Comparative Compound 1)

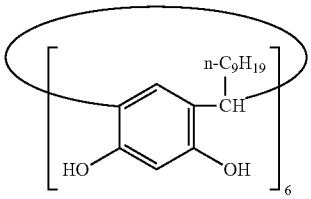

As shown in Table 1, it was found that the non-magnetic toner that uses the charge control agent containing the resorcin derivative represented by the formula (1) of the present invention as an active substance(s) has a high saturated charge amount under high temperature and high humidity (temperature: 35° C., humidity: 85%), and the difference from the saturated charge amount under low temperature and low humidity (temperature: 10° C., humidity: 30%) becomes smaller. That is, the nonmagnetic toner of the invention is a toner having excellent environmental stability.

(Example 11)

(Production and Evaluation of Emulsion Aggregation Toner 1)

(Preparation of Resin Dispersion Solution)

Firstly, 80 parts by mass of a polyester resin (DIACRON ER-561, manufactured by Mitsubishi Rayon Co., Ltd.), 320 parts by mass of ethyl acetate and 32 parts by mass of isopropyl alcohol were mixed. While stirring by a homogenizer (foam-less mixer, NGM-0.5 TB, manufactured by Beryu Co. Ltd.) at 5,000 to 10,000 rpm, an appropriate amount of 0.1 mass % ammonia water was added dropwise to cause phase inversion emulsification. Furthermore, the solvent was removed while reducing pressure by an evaporator to obtain a resin dispersion solution. The volume average particle size of the resin particles in the dispersion solution was 0.2 μm (the resin particle concentration was adjusted to 20 mass % with ion exchange water).

(Preparation of Dispersion Solution of Charge Control Agent)

Firstly, 0.2 part by mass of sodium dodecylbenzenesulfonate, 0.2 part by mass of SORBON T-20 (manufactured by TOHO Chemical Industry Co., Ltd.) and 17.6 parts by mass of ion-exchange water were mixed and dissolved and 2.0 parts by mass of the resorcin derivative (compound 12) synthesized in Synthesis Example 3 and zirconia beads (particle diameter of beads: 0.65 mm.phi., 15 ml equivalent) were added thereto and the mixture was dispersed for 3 hours by a paint conditioner (RED DEVIL NO. 5400-5L produced by UNION N.J. (USA)). The zirconia beads were removed using a sieve, and, by adjusting with ion-exchange water, a 10 mass % dispersion solution of a charge control agent was formed.

(Production of Emulsion Aggregation Toner)

To a reaction container provided with a thermometer, a pH meter and a mixer, 125 parts by mass of the resin dispersion solution, 1.0 part by mass of an aqueous solution of 20 mass % sodium dodecylbenzenesulfonate and 125 parts by mass of ion-exchange water were added and the mixture was stirred at 150 rpm for 30 minutes while controlling a solution temperature at 30° C. An aqueous solution of 1 mass % nitric acid was added thereto to adjust pH to 3.0, followed by further stirring for 5 minutes. While dispersing by a homogenizer (ULTRA-TURRAX T-25 produced by IKA Japan), 0.125 part by mass of polyaluminum chloride was added thereto. The liquid temperature was raised up to 50° C., followed by further stirring for 30 minutes. Then, after 62.5 parts by mass of the above-described resin dispersion liquid and 4.0 parts by mass of the above-described dispersion liquid of a charge control agent were added thereto, an aqueous solution of 1 mass % nitric acid was added thereto to adjust pH to 3.0, further followed by dispersing for 30 minutes. While stirring the solution at 400 to 700 rpm using a mixer, 8.0 parts by mass of an aqueous solution of 5 mass % sodium hydroxide was added thereto, followed by stirring until the volume average particle size of the toner becomes 9.5 μm. After raising the liquid temperature up to 75° C., followed by further stirring for 2 hours, and after confirming that the volume average particle size has become 6.0 μm and a particle form has become spherical, and ice water was used for rapid cooling. Precipitates were collected by filtration and washed by dispersion with ion-exchange water. The dispersion by washing was repeated until the electrical conductivity of the filtrate after the dispersion becomes 20 μS/cm or less. Then, the precipitates were dried by a dryer at 40° C. and toner particles were obtained. The obtained toner was sieved with a 166 mesh sieve (sieve opening: 90 μm) and emulsion aggregation toner 1 was obtained.

(Evaluation)

The obtained emulsion aggregation toner 1 was mixed with a non-coat ferrite carrier (F-150 produced by Powdertech Co., Ltd.) at a ratio of 2 parts by mass to 100 parts by mass and shaken to negatively charge the toner. Then, the saturated charge amount of the toner was measured by a blow-off powder charge amount measurement device under an atmosphere of temperature of 10° C. and humidity of 30% (under LL environment) and under an atmosphere of temperature of 35° C. and humidity of 85% (under HH environment) in the same manner as that of Example 8 to evaluate the environmental stability. Further, in the same manner also in the case of mixing with a silicone-coated ferrite carrier (F96-150 produced by Powdertech Co., Ltd.), the saturated charge amount and the environmental stability were evaluated. The results are collectively shown in Table 2.

TABLE 2

| | | Carrier F-150 | | | Carrier F96-150 | | |
|---|---|---|---|---|---|---|---|
| | Charge control agent | Saturated charge amount (μC/g) LL | Saturated charge amount (μC/g) HH | Environmental stability LL/HH | Saturated charge amount (μC/g) LL | Saturated charge amount (μC/g) HH | Environmental stability LL/HH |
| Example 11 | Compound 12 | −55.5 | −49.1 | 1.13 | −33.6 | −31.1 | 1.08 |

TABLE 2-continued

| | Charge control agent | Carrier F-150 Saturated charge amount (μC/g) LL | HH | Environmental stability LL/HH | Carrier F96-150 Saturated charge amount (μC/g) LL | HH | Environmental stability LL/HH |
|---|---|---|---|---|---|---|---|
| Example 12 | Compound 13 | −56.0 | −48.9 | 1.15 | −36.1 | −32.4 | 1.11 |
| Example 13 | Compound 21 | −50.0 | −32.0 | 1.56 | −36.5 | −30.7 | 1.19 |
| Comparative Example 2 | Comparative compound 2 | −47.3 | −16.1 | 2.94 | −29.9 | −13.3 | 2.25 |

(Example 12)

(Production and Evaluation of Emulsion Aggregation Toner 2)

Emulsion aggregation toner 2 was produced under the same condition as that of Example 11 except that the compound 12 used as the charge control agent in Example 11 was replaced with the resorcin derivative (compound 13) synthesized in Synthesis Example 4, and the saturated charge amount and the environmental stability were evaluated. Results are collectively shown in Table 1.

(Example 13)

(Production and Evaluation of Emulsion Aggregation Toner 3)

Emulsion aggregation toner 3 was produced under the same, condition as that of Example 11 except that the compound 12 used as the charge control agent in Example 11 was replaced with the resorcin derivative (compound 21) synthesized in Synthesis Example 7, and the saturated charge amount and the environmental stability were evaluated. Results are collectively shown in Table 2.

(Comparative Example 2)

(Production and Evaluation of Comparative Emulsion Aggregation Toner)

For comparison, a comparative emulsion aggregation toner was produced under the same condition as that of Example 11 except that the compound 12 used as the charge control agent in Example 11 was replaced with the following comparative compound 2, and the saturated charge amount and the environmental stability were evaluated. Results are collectively shown in Table 2.

[Chemical Formula 34]

(Comparative Compound 2)

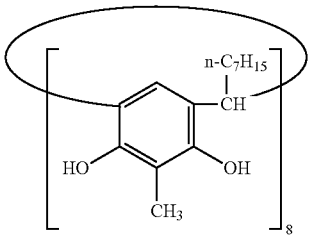

As shown in Table 2, it was found that the emulsion aggregation toner that used the charge control agent containing the resorcin derivative represented by the formula (1) of the invention as an active substance(s) has a high saturated charge amount under high temperature and high humidity (temperature: 35° C., humidity: 85%), and the difference from the saturated charge amount under low temperature and low humidity (temperature: 10° C., humidity: 30%) becomes smaller. That is, the emulsion aggregation toner of the invention is a toner having excellent environmental stability.

(Example 14)

(Production and Evaluation of Suspension Polymerization Toner 1)

(Preparation of Aqueous Dispersion Medium)

In a tall beaker, 382 parts by mass of ion exchange water, and 157 parts by mass of an aqueous solution of 0.3 mol/l $Na_3PO_4$ were added, and while stirring at 3200 rpm by a high-speed stirrer ULTRA TURRAX, the mixture was held at 60° C. by a water bath. After raising the number of rotations of the stirrer up to 10,000 rpm, here, 28 parts by mass of an aqueous solution of 10 mol/l $CaCl_2$ was gradually added, and an aqueous dispersion medium containing fine water-insoluble dispersion stabilizer $Ca_3(PO_4)$ was prepared.

(Preparation of Suspension Polymerization Toner)

Firstly, 19.1 part by mass of styrene monomer, 8.1 parts by mass of n-butylacrylate, 0.3 parts by mass of cyan pigment (PIGMENT BLUE 15:3), 1.5 parts by mass of a polyester resin (trade name: ER-561, manufactured by Mitsubishi Rayon Co., Ltd.), 0.9 parts by mass of the resorcin derivative (Compound 17) synthesized in Synthesis Example 6 and zirconia beads (particle size of the beads: 0.65 mmϕ, 15 ml equivalent) were added to a PP vessel and dispersed for 3 hours by a paint conditioner (RED DEVIL NO. 5400-5L produced by UNION N.J. (USA)). The zirconia beads were removed using a sieve, and an oil layer was obtained. To the oil layer, one part by mass of 2,2'-azobis (2,4-dimethylvallelonitrile) was added as a polymerization initiator, further an aqueous layer obtained by adding 44 g of purified water to 36.5 parts by mass of the above-described aqueous dispersion medium was added. After granulating by holding an internal temperature at 70° C. and by stirring at 7,000 rpm using ULTRA TURRAX, a polymerization reaction was carried out at 80° C. for 5 hours under a nitrogen atmosphere. After the end of the reaction, 35% hydrochloric acid was added to adjust pH to 1 to 2, the solution was filtered, washed with water, and dried at 40° C., and toner particles were obtained. The obtained toner was sieved with a 166 mesh (opening: 90 μm) sieve and suspension polymerization toner 1 having a volume average particle size of 5 to 6 μm was obtained.

(Evaluation)

The obtained suspension polymerization toner 1 was mixed with a non-coat ferrite carrier (trade name: F-150 produced by Powdertech Co., Ltd.) at a ratio of 2 parts by mass to 100 parts by mass and shaken to negatively charge the toner. Then, the saturated charge amount and the environmental stability of the toner were measured by a blow-off powder charge amount measurement device. Further, in the same manner also in the case of mixing with the silicone-coated ferrite carrier (F96-150 produced by Powdertech Co., Ltd.), the saturated charge amount and the environmental stability were evaluated. The results are collectively shown in Table 3.

TABLE 3

| | Charge control agent | Carrier F-150 Saturated charge amount (μC/g) LL | HH | Environmental stability LL/HH | Carrier F96-150 Saturated charge amount (μC/g) LL | HH | Environmental stability LL/HH |
|---|---|---|---|---|---|---|---|
| Example 14 | Compound 17 | −58.6 | −52.8 | 1.11 | −39.3 | −29.3 | 1.34 |
| Example 15 | Compound 13 | −57.6 | −53.2 | 1.08 | −39.8 | −32.5 | 1.22 |
| Example 16 | Compound 21 | −51.1 | −27.7 | 1.84 | −34.4 | −15.0 | 2.29 |
| Comparative Example 3 | Comparative compound 3 | −50.6 | −16.0 | 3.16 | −30.9 | −10.7 | 2.89 |

(Example 15)

(Production and Evaluation of Suspension Polymerization Toner 2)

Suspension polymerization toner 2 was produced under the same condition as that of Example 14 except that the compound 17 used as the charge control agent in Example 14 was replaced with the resorcin derivative (compound 13) synthesized in Synthesis Example 4, and the saturated charge amount and the environmental stability were evaluated. Results are collectively shown in Table 3.

(Example 16)

(Production and Evaluation of Suspension Polymerization Toner 3)

Suspension polymerization toner 3 was produced under the same condition as that of Example 14 except that the compound 17 used as the charge control agent in Example 14 was replaced with the resorcin derivative (compound 21) synthesized in Synthesis Example 7, and the saturated charge amount and the environmental stability were evaluated. Results are collectively shown in Table 3.

(Comparative Example 3)

(Production and Evaluation of Comparative Suspension Polymerization Toner)

A comparative suspension polymerization toner was produced under the same condition as that of Example 14 except that the compound 17 used as the charge control agent in Example 14 was replaced with the following comparative compound 3, and the saturated charge amount and the environmental stability were evaluated. Results are collectively shown in Table 3,

[Chemical Formula 35]

(Comparative compound 3)

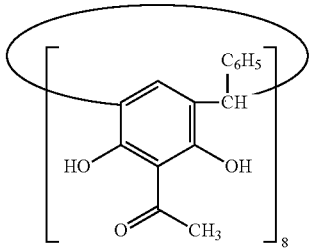

As shown in Table 3, it was found that the suspension polymerization toner that used the charge control agent containing the resorcin derivative represented by the formula (1) of the present invention as an active substance(s) has a high saturated charge amount under high temperature and high humidity (temperature: 35° C., humidity: 85%), and the difference from the saturated charge amount under low temperature and low humidity (temperature: 10° C., humidity: 30%) becomes smaller. That is, the suspension polymerization toner of the invention is a toner having excellent environmental stability.

As obvious from the above results, the toner that uses the charge control agent containing the resorcin derivative represented by formula (1) of the present invention as an active substance(s) has excellent saturated charge amount and a very small decrease in the saturated charge amount even under high temperature and high humidity, that is, excellent environmental stability. When the charge control agent that contains the resorcin derivative represented by the formula (1) of the invention is used, high charging property, in particular, excellent environmental stability may be imparted to the electrostatic image developing toner, in particular, to the polymerization toner.

INDUSTRIAL APPLICABILITY

A charge control agent of the invention has obviously higher charging performance and particularly excellent environmental stability than a conventional charge control agent.

Further, the charge control agent of the invention is most suitable as a color toner, in particular, as a polymerization toner. Furthermore, the charge control agent of the invention may provide a very useful toner because it does not contain also a heavy metal such as a chromium compound that is an environmental concern.

The invention claimed is:

1. A toner comprising a charge control agent containing one or more resorcin derivatives represented by the following formula (2) as an active substance(s), a colorant and a binder;

[Chemical Formula 2]

(2)

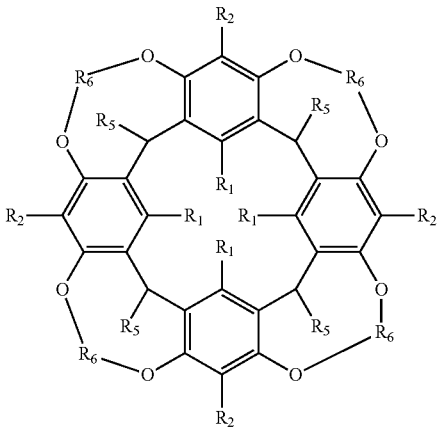

wherein in formula (2), $R_1$ and $R_2$, which may be identical to or different from each other and represent a hydrogen atom, a deuterium atom, a halogen atom, a hydroxyl group, a nitro group, a carboxyl group, an ester group, a linear or branched alkyl group having 1 to 20 carbon atoms which may have a substituent, a cycloalkyl group having 5 to 10 carbon atoms which may have a substituent, a linear or branched alkyloxy group having 1 to 20 carbon atoms which may have a substituent, a cycloalkyloxy group having 5 to 10 carbon atoms which may have a substituent, an acyl group having 2 to 6 carbon atoms which may have a substituent, a substituted or unsubstituted aromatic hydrocarbon group, a substituted or unsubstituted heterocyclic group, or a substituted or unsubstituted condensed polycyclic aromatic group; $R_5$s, which may be identical to or different from each other, represent a hydrogen atom, a deuterium atom, a linear or branched alkyl group having 1 to 20 carbon atoms which may have a substituent, a cycloalkyl group having 5 to 10 carbon atoms which may have a substituent, a substituted or unsubstituted aromatic hydrocarbon group, a substituted or unsubstituted heterocyclic group, or a substituted or unsubstituted condensed polycyclic aromatic group; $R_6$s, which may be identical to or different from each other, represent a divalent group which is formed by mutual binding of $R_3$ and $R_4$ via a single bond; $R_3$ and $R_4$ may be identical to or different from each other, represent a hydrogen atom, a deuterium atom, a linear or branched alkyl group having 1 to 20 carbon atoms which may have a substituent, a cycloalkyl group having 5 to 10 carbon atoms which may have a substituent, a substituted or unsubstituted aromatic hydrocarbon group, a substituted or unsubstituted heterocyclic group, or a substituted or unsubstituted condensed polycyclic aromatic group.

2. The toner according to claim 1, wherein a volume average particle size is from 2 μm to 9.5 μm.

3. The toner according to claim 1, wherein the toner is a polymerization toner.

4. The toner according to claim 1, wherein the toner is an emulsion aggregation toner.

5. The toner according to claim 1, wherein the toner is a suspension polymerization toner.

6. A developer comprising the toner according to claim 1, and a carrier.

7. A developer comprising the emulsion aggregation toner according to claim 4, and a resin-coated carrier.

8. A developer comprising the suspension polymerization toner according to claim 5 and a non-coat carrier.

9. A toner cartridge comprising the developer according to claim 6.

* * * * *